US006751426B2

(12) United States Patent
Akiba et al.

(10) Patent No.: US 6,751,426 B2
(45) Date of Patent: Jun. 15, 2004

(54) IMAGE FORMING APPARATUS, CONTROL APPARATUS AND CONTROL METHOD FOR THE SAME, AND STORAGE MEDIUM PRODUCT

(75) Inventors: Rieko Akiba, Kanagawa (JP); Akinobu Nishikata, Chiba (JP); Tadaaki Saida, Chiba (JP); Yuichiro Maeda, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/995,720

(22) Filed: Nov. 29, 2001

(65) Prior Publication Data

US 2002/0076231 A1 Jun. 20, 2002

(30) Foreign Application Priority Data

Dec. 20, 2000 (JP) ..... 2000-387113

(51) Int. Cl.[7] ..... G03G 15/00
(52) U.S. Cl. ..... 399/82; 399/81; 399/382
(58) Field of Search ..... 399/81, 82, 85, 399/382, 389, 391, 393

(56) References Cited

U.S. PATENT DOCUMENTS 4,609,282 A * 9/1986 Crandall ..... 399/382
4,873,547 A 10/1989 Sasaki et al.
5,337,161 A * 8/1994 Hube
5,457,524 A * 10/1995 Metcalf et al. ..... 399/382
5,481,353 A * 1/1996 Hicks et al. ..... 399/382
5,722,029 A * 2/1998 Tomidokoro et al. ..... 399/389
5,781,842 A * 7/1998 Ito et al. ..... 399/382
5,832,337 A * 11/1998 Isemura ..... 399/81
6,026,258 A * 2/2000 Fresk et al. ..... 399/81
6,469,810 B1 * 10/2002 Momonami et al. .... 399/382 X

* cited by examiner

*Primary Examiner*—Sandra Brase
(74) *Attorney, Agent, or Firm*—Fitzpatrick, Cella, Harper & Scinto

(57) ABSTRACT

In an image forming apparatus in which images are formed on one type of sheets, such as OHP sheets, and at the same time another type of sheets, such as tab sheets, are output and inserted between the former type sheets, the invention makes it possible to avoid the user operation from becoming complicated, to keep users from suffering an increased burden, to provide a desired output result easily handled by the users. To that end, when a storage unit storing tab sheets is designated and the inter-OHP insertion mode is selected, the tab sheets are automatically fed from the storage unit designated by a tab-sheet storage unit designating unit, and are each inserted between OHP sheets.

53 Claims, 17 Drawing Sheets

FIG. 24

STORAGE MEDIUM SUCH AS FD / CD-ROM

| |
|---|
| DIRECTORY INFORMATION |
| FIRST DATA PROCESSING PROGRAM<br>PROGRAM CODE GROUP CORRESPONDING<br>TO STEPS OF FLOWCHART SHOWN IN FIG. 17 |
| SECOND DATA PROCESSING PROGRAM<br>PROGRAM CODE GROUP CORRESPONDING<br>TO STEPS OF FLOWCHART SHOWN IN FIG. 20 |
| THIRD DATA PROCESSING PROGRAM<br>PROGRAM CODE GROUP CORRESPONDING<br>TO STEPS OF FLOWCHART SHOWN IN FIG. 22 |
| |

MEMORY MAP OF STORAGE MEDIUM

IMAGE FORMING APPARATUS, CONTROL APPARATUS AND CONTROL METHOD FOR THE SAME, AND STORAGE MEDIUM PRODUCT

BACKGROUND OF THE INVENTION

1. Field of the Invention

The present invention relates to an image forming apparatus, such as a copying machine, which has the function of inserting another type of sheet between one type of sheets on which images are formed, e.g., the function of inserting another type of sheet, such as an ordinary sheet, between every two OHP sheets on which images are formed, and which can efficiently handle several types of sheets including media-type sheets such as tab sheets. The present invention also relates to a control apparatus and a control method for the image forming apparatus, and a storage medium product.

2. Description of the Related Art

In a conventional image forming apparatus, the so-called inter-OHP inserting function is performed as follows. Users set a plurality of OHP sheets in a manual feed tray associated with the image forming apparatus, and also set a plurality of ordinary sheets, which have the same size as the OHP sheets, in a sheet supply cassette loaded in the apparatus. Then, each time a read document image is copied on one OHP sheet, one ordinary sheet is fed from the sheet supply cassette and then ejected while it remains blank or after an image has been formed on it. In this mode, the OHP sheet and the ordinary sheet are alternately output in the order of OHP, ordinary sheet, OHP, ordinary sheet, and so on.

Meanwhile, an image forming apparatus having the so-called tab sheet mode has also been proposed recently. In the tab sheet mode, an image can be copied (printed) on a tab sheet having a tab (projection for index) formed at a part of the sheet along a side edge. After the formation of an image, the tab sheet is ejected such that it is inserted between ordinary sheets.

The inter-OHP inserting function is a mode for enabling the output OHP sheets to be easily turned over (separated). If a tab sheet having a tab can be inserted in the mode of inter-OHP inserting function, it would be more convenient for uses because they can more easily turn over the copied OHP sheets.

In the conventional image forming apparatus, however, the inter-OHP insertion mode and the tab sheet mode are handled as independent modes. Also, when the inter-OHP insertion mode is set, sheets having the same size as OHP sheets are automatically selected as sheets to be inserted. Extra and troublesome setting work is therefore required for users. Specifically, for example, when using tab sheets as inserted sheets, users must change the setting such that a sheet feed stage for the inserted sheets is set to the sheet feed stage on which the tab sheets are placed, and also must designate setting items on the independent setting screens while paying due consideration to the mode change.

Thus, when attempting to realize an image forming apparatus which can form images on one type of sheets, such as OHP sheets, and at the same time can output and insert another type of sheets such as tab sheets, it is desired to avoid the user operation from becoming complicated, and to keep users from suffering an increased burden.

SUMMARY OF THE INVENTION

Accordingly, it is an object of the present invention to provide an image forming apparatus, a control apparatus and a control method for the image forming apparatus, and a storage medium product, which have succeeded in overcoming the problems set forth above.

A more specific object of the present invention is to provide an image forming apparatus, a control apparatus and a control method for the image forming apparatus, and a storage medium product, which can form images on one type of sheets, such as OHP sheets, and at the same time can output another type of sheets, such as tab sheets, to be inserted between the former type sheets, while avoiding the user operation from becoming complicated and keeping users from suffering an increased burden, and which can present a desired output result easily handled by the users.

Further objects, features and advantages of the present invention will become apparent from the following description of the preferred embodiments with reference to the attached drawings.

BRIEF DESCRIPTION OF THE DRAWINGS

FIG. 24 is a representation for explaining a memory map of a storage medium that stores various data processing programs readable by the image forming apparatus according to the present invention.

DESCRIPTION OF THE PREFERRED EMBODIMENTS (First Embodiment)

Figure 1:
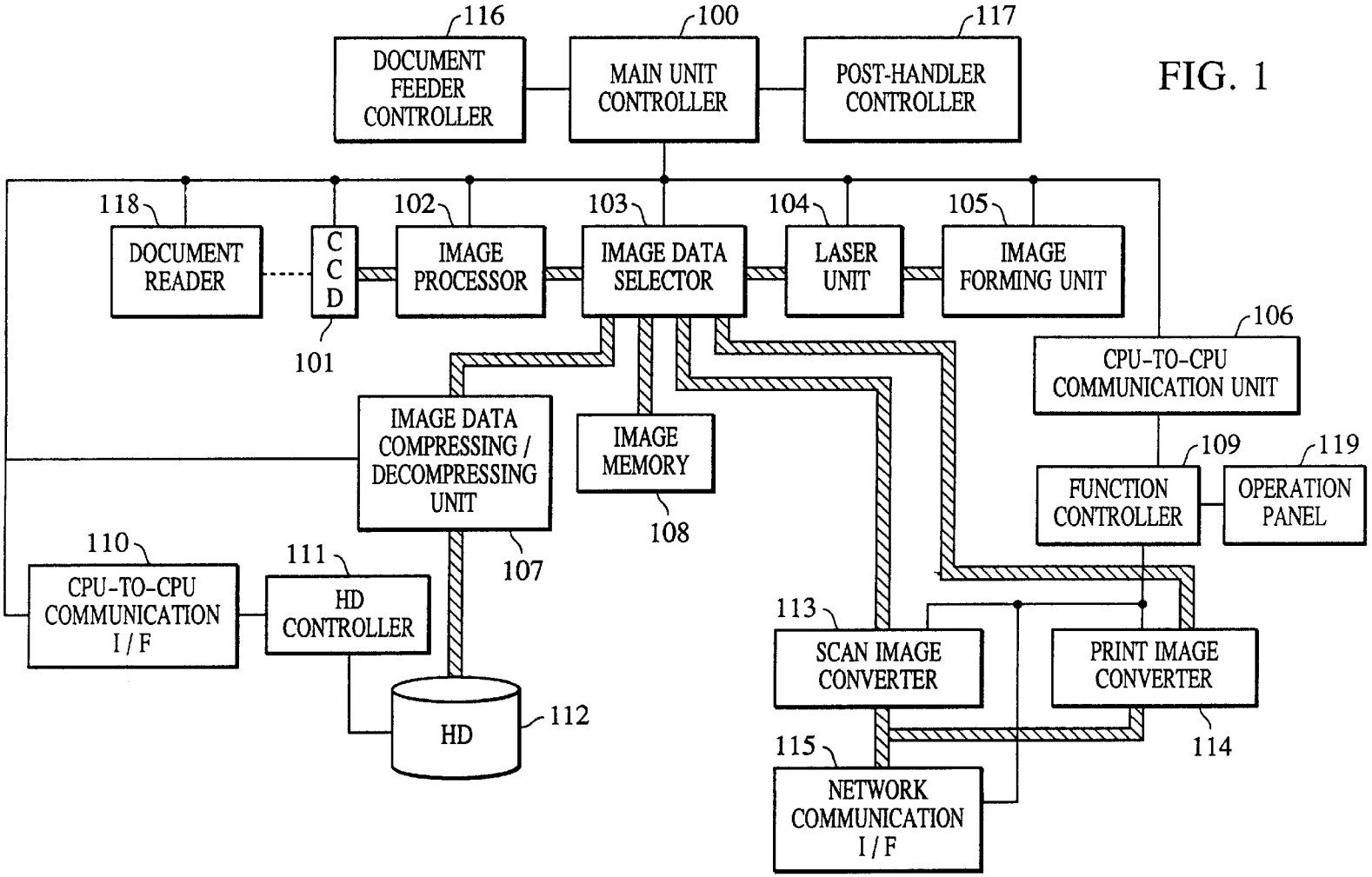
FIG. 1 is a block diagram showing a circuit configuration of a control circuit in an image forming apparatus according to a first embodiment of the present invention.

FIG. 1 is a block diagram showing a circuit configuration of a control circuit in an image forming apparatus according to a first embodiment of the present invention.

Referring to FIG. 1, numeral 100 denotes a main unit controller of the image forming apparatus, which operates and controls a document reader 118, an image forming unit 105, and so on. The main unit controller 100 comprises a CPU (not shown), a RAM for providing a work area for the CPU, and a ROM for storing control programs for the entire image forming apparatus, including programs to execute later-described various operation modes (along with programs for executing the processing of various flowcharts described later, a display control program for the operation panel in this embodiment, and so on).

The main unit controller 100 performs operation control of the image forming apparatus and image data control. For example, in an image processor 102, image read by a CCD 101 is converted into desired image data. In an image data selector 103, control is performed on to which one of a laser unit 104, an image data compressing/decompressing unit 107, an image memory 108 and a function controller 109 the read image data is introduced. Further, a command for document feed is issued to a document feeder controller 116, and which mode is to be set is instructed to a post-handler controller 117. In addition, the main unit controller 100 executes the tab sheet insertion mode, the tab sheet creation mode, the inter-OHP insertion mode, etc., which will be described below.

Numeral 101 denotes a CCD which receives light reflected from a document image, which is obtained from the document reader 118 by illuminating light upon a document. The document reader 118 comprises a document platen, a document illuminating unit, an optical system, etc. Then, the CCD 101 performs optoelectronic conversion of the received light and outputs image data. In the image processor 102, the image data output from the CCD 101 is subjected to image processing corresponding to the image processing functions set on the operation panel 119.

The image data selector 103 is connected via an image data bus to the laser unit 104, the image data compressing/decompressing unit 107, the image memory 108, a scan image converter 113, and a print image converter 114, which will be described below. Then, the image data selector 103 selects the direction in which image data flows, based on control information supplied from the main unit controller 100 to decide the flow of image data.

The laser unit 104 performs laser exposure of the document image for development of the image data on a sheet in the image forming unit 105. The image forming unit 105 actually develops the image data, which has been subjected to the laser exposure, on a sheet. A CPU-to-CPU communication I/F (interface) 106 serves to communicate control information between the main unit controller 100 and a function controller 109 described later.

The image data compressing/decompressing unit 107 compresses the image data output from the image data selector 103 for saving a proportion of the image data occupying in a hard disk (HD) 112, which is a large-capacity nonvolatile memory, when the image data is accumulated in the HD 112, and also decompresses the compressed image data in the HD 112 into the original one when the image data is transferred to the image data selector 103.

The image memory 108 is constituted as a volatile memory for temporarily storing the image data sent from the image data selector 103, and for transferring the image data, temporarily stored therein, to the image data selector 103.

The function controller 109 communicates with the main unit controller 100 to transfer the image data from the image data selector 103 to the scan image converter 113. Also, the function controller 109 sends, to the main unit controller 100 via a CPU-to-CPU communication I/F 110, image data control information for transferring image data from the print image converter 114 to the image data selector 103, and image-forming-apparatus control information from the operation panel 119 of the main unit.

Numeral 110 denotes a CPU-to-CPU communication I/F through which control information for the image data stored in the HD 112 is communicated between a HD controller 111 (described below) and the main unit controller 100. Numeral 111 denotes a HD controller for performing control to write the image data transferred from the image data compressing/decompressing unit 107 in the HD 112, and to read the image data stored in the HD 112 and then transfer the read image data to the image data compressing/decompressing unit 107 in accordance with the control information sent from the main unit controller 100 via the CPU-to-CPU communication I/F 110. The HD 112 is constituted as a nonvolatile memory in and from which the image data sent from and to the image data compressing/decompressing unit 107 is written and read under control of the HD controller 111.

The scan image converter 113 converts the image data, which is transferred from the image data selector 103 under control of the main unit controller 100, into the form readable by application software operating on a host computer (not shown) that is connected to a network communication I/F 115 (described later) via a network.

The print image converter 114 converts image data, which is described in PDL and transferred from application software operating on the host computer (not shown) connected to the network communication I/F 115 via the network, into image data that can be printed in and output from the image forming unit 105 of the image forming apparatus.

The network communication I/F 115 serves as a communication I/F for connection between the image forming apparatus and the network. In accordance with the specific communication protocols, the network communication I/F 115 communicates with equipment (such as a computer) on the network to send image data and control information.

The document feeder controller 116 controls a document feeder for feeding plural types of documents, which will be described later in detail with reference to FIG. 3, to the document platen. The document feeder controller 116 feeds the documents in accordance with control information from the main unit controller 100.

The post-handler controller 117 performs post-handling of output sheets, which will be described later in detail with reference to FIG. 2, in accordance with control information from the main unit controller 100. The document reader 118 includes an optical unit driver for driving an optical unit that comprises a document illuminating means, an optical means, etc. The document reader 118 illuminates light to a document and drives the optical unit in accordance with control information from the main unit controller 100, so that the light reflected from a document image is applied to the CCD 101.

Numeral 119 denotes an operation panel of the image forming apparatus of this embodiment. Key-in information from the operation panel 119 is notified to the function controller 109. The function controller 109 analyzes key-in commands and sends control information for the apparatus operation to the main unit controller 100 via the CPU-to-CPU communication I/F 106.

The basic operation of the circuit configuration, shown in FIG. 1, will be briefly described below, taking as an example 50% scale-down copy.

First, a key representing a 50% scale-down is depressed in the operation panel 119, and a key input is notified to the function controller 109. The function controller 109 analyzes a key-in command indicating that the 50% scale-down key has been depressed, and stores the analyzed information therein. Then, a copy start button is depressed in the operation panel 119, and a key input is notified to the function controller 109. The function controller 109 analyzes a key-in command indicating that the copy start button has been depressed, and notifies the copy start, along with copy information representing the copy mode, the 50% scale-down, the substitute number (number of copied sheets: 1 in this example), etc., to the main unit controller 100 via the CPU-to-CPU communication I/F 106.

Upon receiving the notice from the function controller 109, the main unit controller 100 monitors the status of the document feeder controller 116 and the post-handler controller 117, as well as the status of the HD controller 111 via the CPU-to-CPU communication I/F 110. After determining that the copy start is enabled, the main unit controller 100 executes various settings. Because of the 50% scale-down, it executes the setting for 50% scale-down in the image processor 102. Because of the copy mode, it executes the setting in the image data selector 103 to establish an image path such that the image data flows to the image data compressing/decompressing unit 107, the image memory 108 and the laser unit 104. Because of the copy start, it confirms the status of the document reader 118 through the document feeder controller 116. When a document is present, the main unit controller 100 instructs the document feeder controller 116 to feed a document, and instructs the document reader 118 to move the document fed from the document feeder to a position at which the document can be read.

Simultaneously, the main unit controller 100 confirms the status of a post-handler through the post-handler controller 117, and instructs the post-handler controller 117 to make the post-handler ready for receiving an output sheet ejected from the image forming unit 105 after an image has been printed on it. Further, the read image of the document is written in the HD 112 through the image data selector 103 and the image data compressing/decompressing unit 107, and the image data is read out of the HDD 112 when a document is made up of plural sections or when the substitute number is plural. Depending on the case, therefore, the main unit controller 100 instructs the HD controller 111 via the CPU-to-CPU communication I/F 110 to execute the setting to perform writing and reading in and from the HD 112 as required.

Subsequently, to carry out the copy operation, the main unit controller 100 initializes the CCD 101, the laser unit 104, and the image forming unit 105. It then confirms through the document feeder controller 116 that the document feeder has fed the document to the document reading position, and through the post-handler controller 117 that the post-handler is ready for receiving an output sheet ejected from the image forming unit 105 after an image has been printed on it. It also confirms that the document reader 118 has reached the position at which the reader can read an image of the document on the document platen, and that an output sheet is in a print-enabled state in the image forming unit 105. Thereafter, for starting print outputting of the image, the main unit controller 100 instructs the image processor 102, the image data selector 103, the image memory 108, the image data compressing/decompressing unit 107, and the HD controller 111 to start a process of taking in the image data that is obtained from the CCD 101 by optoelectrically converting the reflected light from the document image.

Then, since the substitute number is 1, the main unit controller 100 measures a time until the image data to be written in the image memory 108 is written to such an extent that the print outputting is able to start. When the measure time is reached, the main unit controller 100 instructs the image data selector 103, the laser unit 104 and the image forming unit 105 to start the print outputting.

Figure 2:
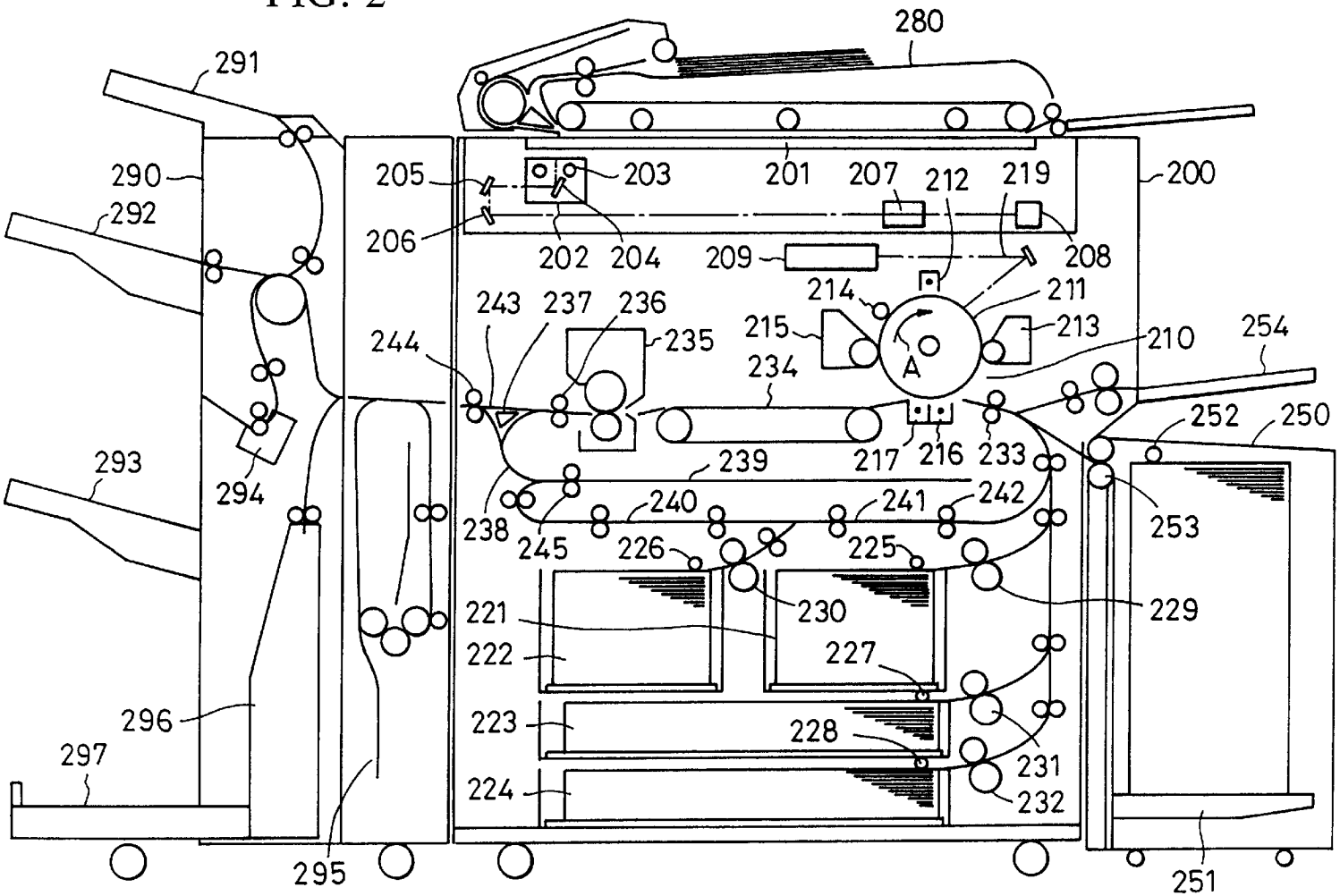
FIG. 2 is a sectional view showing a construction of the image forming apparatus according to the first embodiment of the present invention.

FIG. 2 is a sectional view showing a construction of the image forming apparatus according to the first embodiment of the present invention.

Referring to FIG. 2, numeral 200 denotes a main unit of the image forming apparatus (referred to simply as a "main unit" hereinafter), 280 denotes an automatic document feeder (ADF), and 201 denotes is a platen glass serving as a rest on which a document is placed.

Numeral 202 denotes a scanner comprising a document illuminating lamp 203, a scan mirror 204, and so on. The scanner 202 is moved reciprocally in a predetermined direction by a motor (not shown) so that the reflected light from the document passes a lens 207 through scan mirrors 204, 206 and is focused on a CCD sensor (CCD 101 shown in FIG. 1) within an image sensor unit 208.

Numeral 209 denotes an exposure controller comprising a laser, a polygonal scanner, etc. In accordance with an image signal resulting through conversion into an electrical signal in the image sensor unit 208 and through predetermined image processing (described later), the exposure controller 209 irradiates a laser beam 219 onto a photoconductive drum 211. Around the photoconductive drum 211, there are disposed a primary charger 212, a developing device 213, a transfer charger 216, a pre-exposure lamp 214, and a cleaning device 215.

In an image forming section 210, the photoconductive drum 211 is rotated by a motor (not shown) in a direction of arrow shown in the drawing. After the photoconductive drum 211 has been charged to a desired potential by the primary charger 212, the laser beam 219 is irradiated onto the photoconductive drum 211 from the exposure controller 209, whereby an electrostatic latent image is formed. The electrostatic latent image formed on the photoconductive drum 211 is developed by the developing device 213 and is visualized as a toner image.

On the other hand, a transfer sheet is supplied from a right cassette deck 221, a left cassette deck 222, an upper stage cassette 223 or a lower stage cassette 224 by a pickup roller 225, 226, 227 or 228, and is sent to the main unit by a sheet feed roller 229, 230, 231 or 232. Then, the transfer sheet is fed toward a transfer belt 234 by a register roller 233, while the visualized toner image is transferred onto the transfer sheet by the transfer charger 216.

After the image transfer, the remaining toner on the photoconductive drum 211 is removed by the cleaning device 215, and the remaining charges thereon is eliminated by the pre-exposure lamp 214. The transfer sheet, onto which the image has been transferred, is separated from the photoconductive drum 211 by a separation charger 217 and then fed to a fusing device 235 by the transfer belt 234.

In the fusing device 235, the transferred image is fixedly fused and ejected out of the main unit 200 by a sheet ejection roller 236. The main unit 200 includes a deck 250 capable of accommodating, e.g., 4000 pieces of transfer sheets. A lifter 251 of the deck 250 rises depending on the amount of transfer sheets so that a top one of stacked transfer sheets is always brought into contact with a pickup roller 252. Each transfer sheet is fed to the main unit by a paper feed roller 253. Further, a multi-manual feed tray 254 capable of accommodating 100 pieces of transfer sheets is provided.

Numeral 237 denotes a sheet ejection flapper for changing over a sheet path between a feed path 238 and an ejection path 243. Numeral 240 denotes a lower feed path. A transfer sheet delivered from the sheet ejection roller 236 advances toward the lower feed path 240 after being turned upside down in a reverse path 239. The reversed transfer sheet is then introduced to a sheet re-feed path 241. A transfer sheet supplied from the left cassette deck 222 by the sheet feed roller 230 is also introduced to the sheet re-feed path 241. Numeral 242 denotes a sheet re-feed roller for feeding a transfer sheet to the image forming section 210 again.

Numeral 244 denotes an ejection roller disposed near the sheet ejection flapper 237 to eject a transfer sheet that is advanced to the ejection path 243 after passing the sheet ejection flapper 237 changed over to a lower position as shown. In both-side recording (copying), the sheet ejection flapper 237 is changed over to an upper position, and a transfer sheet having an image already copied on one side is introduced to the sheet re-feed path 241 through the feed path 238, the reverse path 239 and the lower feed path 240. At this time, the transfer sheet is drawn by a reverse roller 245 into the reverse path 239 to such a position that the tailing end of the transfer sheet is completely drawn out of the feed path 238, but it is nipped by the reverse roller 245. In such a condition, the reverse roller 245 is rotated backward to deliver the transfer sheet toward the lower feed path 240.

When ejecting a transfer sheet in a reversed state from the main unit, the sheet ejection flapper 237 is changed over to the upper position to introduce the transfer sheet toward the reverse path 239. After the transfer sheet is drawn by the reverse roller 245 into the reverse path 239 to such a position that the tailing end of the transfer sheet still remains in the feed path 238. In such a condition, the reverse roller 245 is rotated backward to deliver the transfer sheet, which is turned upside down, toward the ejection roller 244.

Numeral 290 denotes a ejected sheet handling device for neatly aligning and binding transfer sheets ejected out of the main unit 200. The transfer sheets ejected one by one are stacked on a handling tray 294 so as to neatly align at edges. When ejection of one set of transfer sheets is completed after formation of a series of images on the sheets, a bundle of the transfer sheets are bound together by stapling and then ejected onto a sheet ejection tray 292 or 293 in the bundle form.

The sheet ejection tray 293 is vertically moved by a motor (not shown) under control such that it locates at a position of the handling tray before the start of the image forming operation. Numeral 291 denotes a sheet tray on which marking sheets to be inserted between desired two ejected transfer sheets are placed. Numeral 295 denotes a Z-folding device for Z-folding the ejected transfer sheet.

Numeral 296 denotes a binding device for folding a set of ejected transfer sheets together at the center, and binding them by stapling. A bundle of bound transfer sheets are ejected onto an ejection tray 297.

Figure 3:
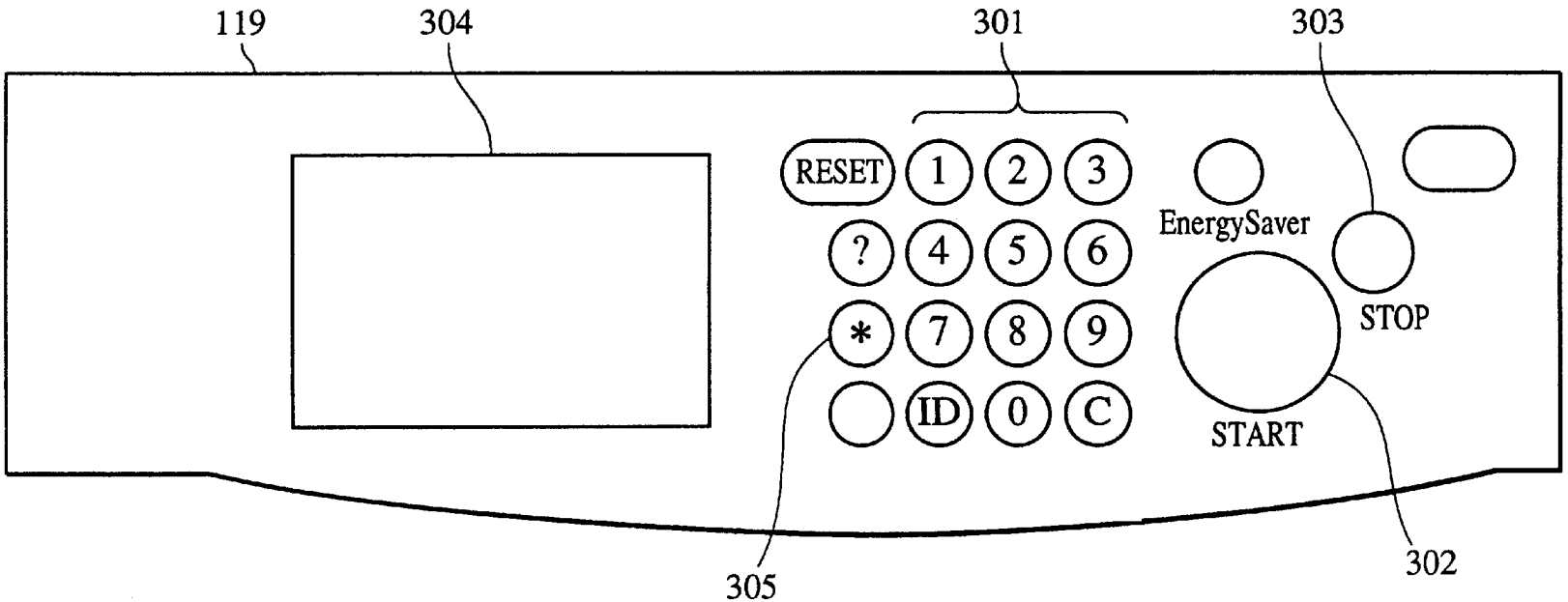
FIG. 3 is a plan view showing details of a construction of an operation panel shown in FIG. 1.

FIG. 3 is a plan view showing details of a construction of the operation panel 119 shown in FIG. 1.

Referring to FIG. 3, numeral 301 denotes ten-digit key pad used when inputting the substitute number (number of copies), the amount of image movement, etc. Numeral 302 denotes a start key used when starting a copy job. Numeral 303 denotes a stop key depressed for stopping the copy job when users want to suspend the job having started.

Numeral 304 denotes a LCD (display and entry unit) having a touch panel on its surface. Generally, the LCD 304 is used to set copy job modes (including a plurality of image forming operation modes such as one-side copying, two-side copying, scale-down layout mode, inter-OHP inserting mode, and tab sheet output mode), and to display the operating status of the image forming apparatus (copying machine). Numeral 305 denotes a user mode key used for setting various items in the user mode to make setting of the operation and display that should be reflected on the standard mode for the image forming apparatus (copying machine).

Setting of a tab sheet feed stage in the user mode will be described below with reference to FIGS. 4 to 7.

Figure 4:
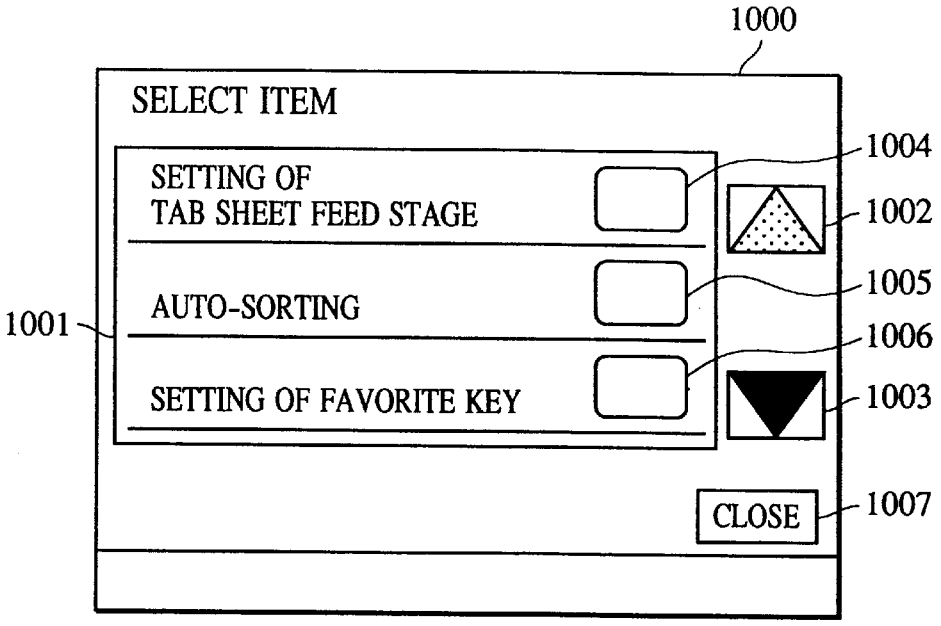
FIG. 4 is a representation showing one example of a screen displayed on a LCD when a user mode key shown in FIG. 3 is depressed.

FIG. 4 is a representation showing one example of a screen displayed on the LCD 304 when the user mode key 305 on the operation panel 119, shown in FIG. 3, is depressed.

Referring to FIG. 4, numeral 1000 denotes a user mode setting screen in which settable mode items (such as setting of tab sheet feed stage, auto-sorting, and setting of favorite key) are listed in a window 1001. Upon depressing of a scroll-up key 1002 and a scroll-down key 1003, a highlighted item is moved from one item to another on the window 1001. FIG. 4 represents a state where no items exist above the top item and the scroll-up key 1002 is displayed gray, thus indicating that the scroll-up key 1002 is not responsive even when it is depressed.

Numeral 1004 denotes a key for setting the tab sheet feed stage. When users depress the key 1004, a tab-sheet feed stage setting subwindow 1010 (described later) shown in FIG. 5.

Numeral 1005 denotes an inter-OHP inserted tab sheet setting key. Depressing this key 1005 displays a subwindow for on/off setting of auto-sorting. Numeral 1006 denotes a favorite key setting key. Depressing this key 1006 displays a subwindow, in a part of a standard screen (described later) shown in FIG. 8, for displaying setting keys with regard to an application mode and zooming, and for allowing users to set the favorite function of jumping certain steps of the setting operation. Numeral 1007 denotes a close key. Depressing this key 1007 brings the setting in the user mode to an end for return to the standard screen (described later). Additionally, depressing the user mode key 305 also returns the screen to the standard one as with the depression of the close key 1007.

Figure 5:
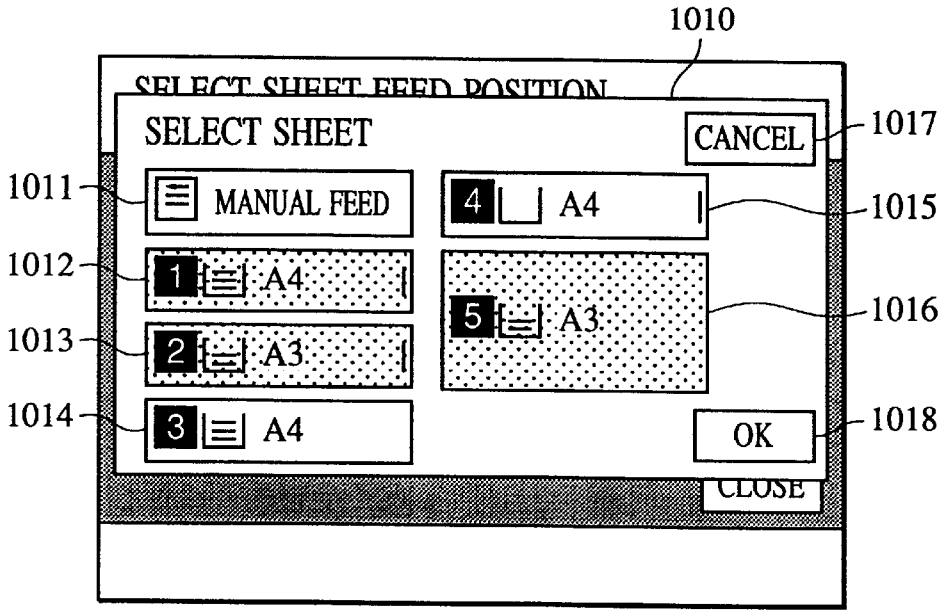
FIG. 5 is a representation showing one example of a tab-sheet feed stage setting subwindow displayed on the LCD, shown in FIG. 3, when a key for setting a tab-sheet feed stage, shown in FIG. 4, is depressed.

FIG. 5 is a representation showing one example of the tab-sheet feed stage setting subwindow 1012 displayed on the LCD 304, shown in FIG. 3, when the key 1004 for setting the tab-sheet feed stage, disposed on an operating screen shown in FIG. 4, is depressed. The subwindow 1010 allows users to set and register which one of a plurality of sheet feed stages associated with the image forming apparatus is to be employed as the feed stage for tab sheets. The information set by users at this time is held as management information in an internal memory.

Referring to FIG. 5, numerals 1011 to 1016 denote sheet feed stage selection keys. These keys are displayed on the screen such that the multi-manual feed tray 254 shown in FIG. 2 corresponds to the key 1011, the right cassette deck 221 corresponds to the key 1012, the left cassette deck 222 corresponds to the key 1013, the upper stage cassette 223 corresponds to the key 1014, the lower stage cassette 224 corresponds to the key 1015, and the deck 250 corresponds to the key 1016.

In this connection, key display is controlled as follows. The sheet feed stages selectable as the tab sheet feed stage are displayed in a normal manner (indicating a state selectable by users) as shown at the keys 1011, 1014 and 1015. The sheet feed stages not selectable as the tab sheet feed stage are displayed in a hatched manner (indicating a state not selectable by users) as shown at the keys 1012, 1013 and 1016. Thus, by not only discriminating the sheet feed stages into ones allowed to use as the tab sheet feed stage and others prohibited to use as such, but also performing the display control as described above, it is possible to prevent erroneous setting by users and to improve operability.

Numeral 1018 denotes an OK key. Depressing this key 1018 after selecting the sheet feed stage establishes the setting of the tab-sheet feed stage and closes the subwindow for return to the user mode setting screen 1000 shown in FIG. 4. The established setting data is stored in a nonvolatile memory as a part of the internal RAM (not shown) of the main unit controller 100 shown in FIG. 1.

It is assumed, for example, that users place tab sheets on one of the plurality of sheet feed stages associated with the image forming apparatus, which corresponds to the No. 3 cassette, and sets and registers the No. 3 cassette as the tab sheet feed stage. In such a case, by depressing the key 1014 corresponding to the No. 3 cassette on a screen 1010 and then depressing the OK key 1018, users can set and register, as the tab sheet feed stage, the No. 3 cassette among the plural candidates of tab sheet feed stage.

The image forming apparatus stores the registered information in the RAM, and after that, executes various control in accordance with the store setting information. For example, when the tab sheet mode is instructed in the image forming operation, a tab sheet is fed from the No. 3 cassette, which has been registered as the tab sheet feed stage, for tab-sheet insertion between copied sheets or forming an image on the tab sheet fed from the No. 3 cassette.

The image forming apparatus is able to acquire the setting information entered by users through the above-mentioned screens, and to recognize what type of recording sheets (media type) is placed in each of the sheet feed stages, e.g., the fact that the type of recording sheets (media type) is placed in the No. 3 cassette is a tab sheet. Also, information regarding the size of recording sheets (media size) is obtained for each of the sheet feed stages in accordance with a detection result from a size sensor provided in a one-to-one relation to the sheet feed stages. The remaining amount of recording sheets can also be detected for each of the sheet feed stages in accordance with a detection result from a remaining-amount sensor provided in a one-to-one relation to the sheet feed stages.

Without using the above-mentioned screen 1010, the media type may be set and registered as initial setting for each of the sheet feed stages beforehand by displaying a recording-sheet type setting screen on which the type of recording sheet can be set for each of the sheet feed stages, and then choosing a desired item on the recording-sheet type setting screen. In that case, the tab sheet feed stage can be set at the time of initial setting by setting the media type for each of the sheet feed stages, for example, such that the No. 1 cassette corresponds to ordinary sheets, the No. 2 cassette corresponds to color sheets, and the No. 3 cassette corresponds to tab sheets.

Numeral 1017 denotes a cancel key. Depressing this key 1017 cancels the tab-sheet feed stage setting and closes the subwindow for return to the user mode screen 1000 shown in FIG. 4.

When the setting of the tab sheet feed stage has not been made by users, tab-sheet related mode setting keys are not displayed in an application mode screen, as shown FIG. 6 (described later), which is displayed to perform various operation mode settings necessary for copying, so that the users are prohibited from setting the tab-sheet related operation modes in the image forming operation. On the other hand, when the setting of the tab sheet feed stage has been made by users on the screen 1010, a tab-sheet insertion mode key 344 and a tab-sheet creation mode key 345 are displayed in the application mode screen, as shown FIG. 7 (described later), so that the users are allowed to set the tab-sheet related operation modes in the image forming operation.

Also, in the inter-OHP insertion mode described later, control is performed in different ways depending on whether the setting of the tab sheet feed stage has been made or not.

Figure 6:
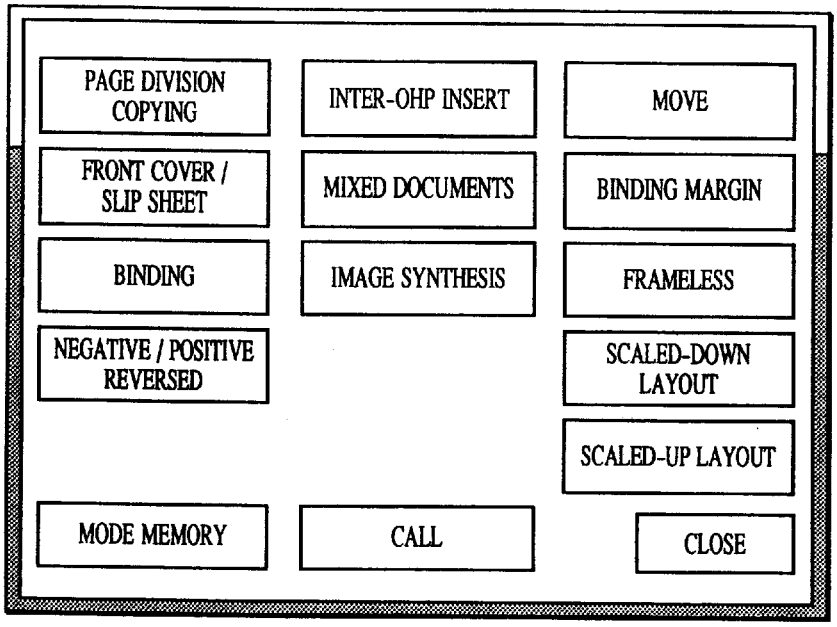
FIG. 6 is a representation showing one example of an application mode screen, displayed on the LCD shown in FIG. 3, for making various mode settings necessary for copying.

FIG. 6 is a representation showing one example of the application mode screen, displayed on the LCD 304 shown in FIG. 3, for making various mode settings necessary for copying. The application mode screen of FIG. 6 corresponds to the case where the tab sheet feed stage has not been set on the tab-sheet feed stage setting subwindow 1010 shown in FIG. 5. Therefore, the tab-sheet related mode setting keys are not displayed in the application mode screen of FIG. 6. Thus, when the tab sheet feed stage has not been set in the previous setting step, it is prohibited to set the tab-sheet related operation modes as application modes in the image forming operation through the display control described above.

Figure 7:
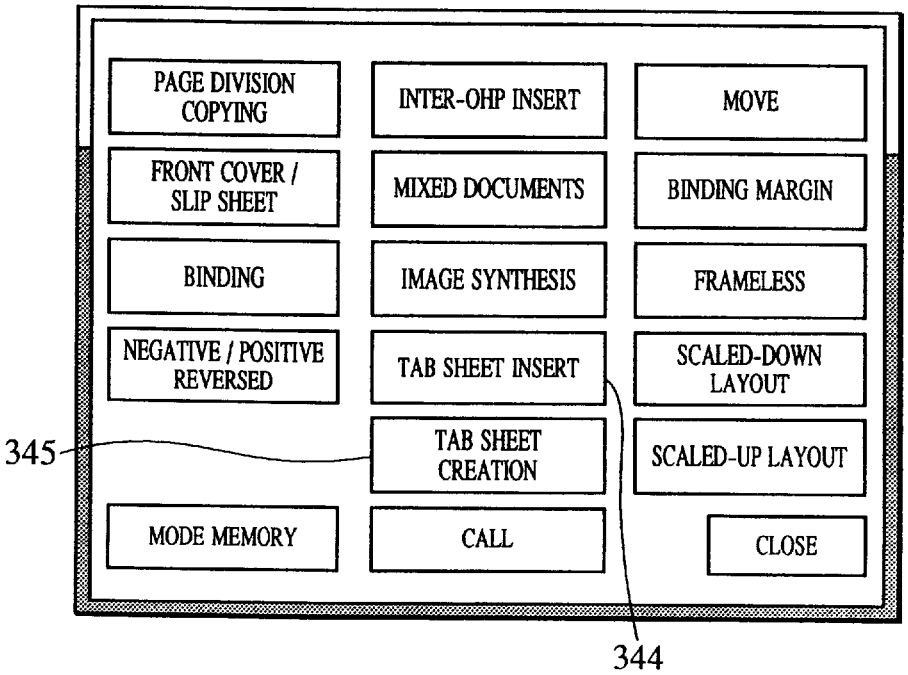
FIG. 7 is a representation showing one example of an application mode screen, displayed on the LCD shown in FIG. 3, for making various mode settings necessary for copying.

FIG. 7 is a representation showing one example of the application mode screen, displayed on the LCD 304 shown in FIG. 3, for making various mode settings necessary for copying. The application mode screen of FIG. 7 corresponds to the case where the tab sheet feed stage has been set on the tab-sheet feed stage setting subwindow 1010 shown in FIG. 5. Therefore, the tab-sheet insertion mode key 344 and the tab-sheet creation mode key 345 are displayed as shown, allowing users to make the tab-sheet related settings. Details of the application mode screen of FIG. 7 will be described later with reference to FIG. 10. Thus, when the tab sheet feed stage has been set in the previous setting step, it is allowed to set the tab-sheet related operation modes as application modes in the image forming operation through the display control described above.

Figure 8:
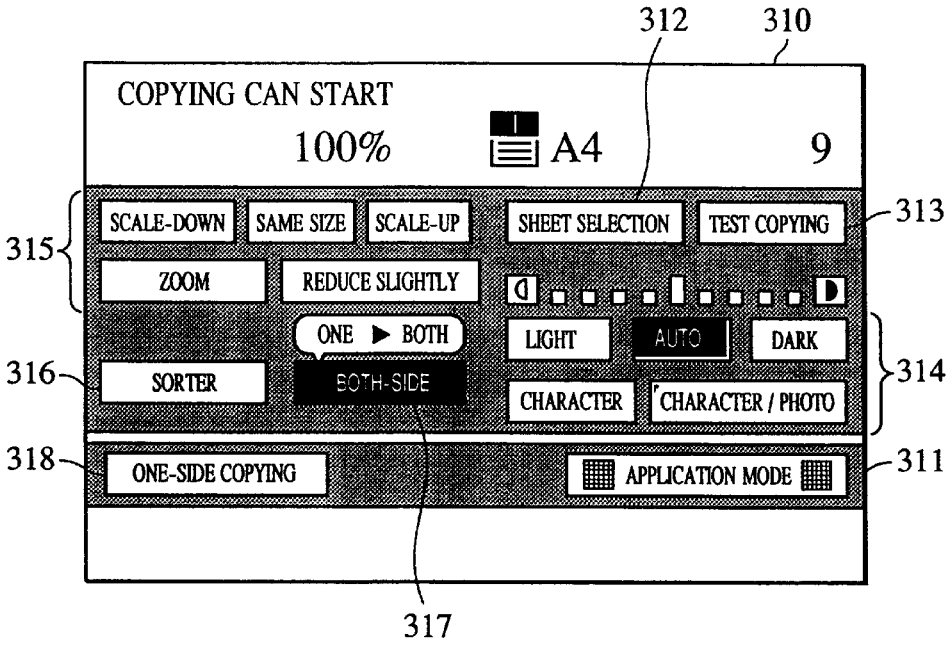
FIG. 8 is a representation showing one example of a standard screen displayed on the LCD shown in FIG. 3.

FIG. 8 is a representation showing one example of a standard screen displayed on the LCD 304 shown in FIG. 3.

Referring to FIG. 8, numeral 310 denotes the standard screen. Copy processing is executed upon the start key 302 being depressed in the condition where the standard screen is displayed.

Numeral 311 denotes an application mode icon. Upon depression of this icon 311, the application mode (setting) screen (FIGS. 6, 7 or 10 described later) is opened as a subwindow for setting various windows. As described above, the contents displayed on the application mode setting screen differ depending on whether the setting of the tab sheet feed stage has been made or not in the previous setting step. Numeral 312 denotes a sheet feed stage selection (sheet selection) icon. Upon depression of this icon 312, a subwindow for selecting the sheet feed stage, shown in FIG. 9 (described later), is opened to display the sheet feed stages for selection.

Numeral 313 denotes a test copying key. When forming plural copies of a document, this key 313 is used to copy and output, as a test sample, only the first copy. Numeral 314 denotes a group of keys for deciding the image mode. These keys enable users to select the image mode such as automatic density correction, the character mode, the character/photo mode, and the photo mode. When the character mode, the character/photo mode or the photo mode is selected, the image density can be changed by operating light keys and dark keys.

Numeral 315 denotes a group of keys for varying the rate at which a document is to be enlarged or reduced. These keys include a 100%, same size key, a scale-down key, a scale-up key, a zoom key in units of 1%, and a slightly reducing key used to copy the whole of a document. Upon any of those keys being depressed, the scale-up or -down rate of a document is changed and the newly set rate is displayed after setting the scale-up or -down rate.

Numeral 316 denotes a sorter key used to set a finishing manner for output sheets. This sorter key 316 can set, e.g., the sorting mode for copying plural pieces of documents as one set and then outputting the set in plural number, the group sorting mode for outputting copies of each of documents in number corresponding to the set substitute number, and a stapling mode for neatly aligning each set of copies output in the sorting mode and then stapling them together.

Numeral 317 denotes a both-side key for setting the both-side mode in which image data can be selectively read from and output onto one side or both sides of a document and a sheet. This both-side key 317 can set, e.g., the one-to-both mode for reading image data from one side of a document and outputting prints onto both sides of a sheet, the both-to-both mode for reading image data from both sides of a document and outputting prints onto both sides of a sheet, the both-to-one mode for reading image data from both sides of a document and outputting a print onto one side of a sheet, and the page division-to-both mode for reading image data from two divisions of one side of a document and outputting prints onto both sides of a sheet.

FIG. 8 shows a display example in which the one-to-both mode is set as one of the both-side mode. A balloon "one→both" is displayed above the both-side icon 317.

Numeral 318 denotes a one-side copying key. This key 318 corresponds to the case where, in the setting of the favorite function described above in connection with FIG. 4, the setting to perform the one-side copying (in which image data is read from one side of a document and output onto one side of a sheet) is displayed as a "favorite key". Upon depression of the key 318, the one-side copying mode is set.

Figure 9:
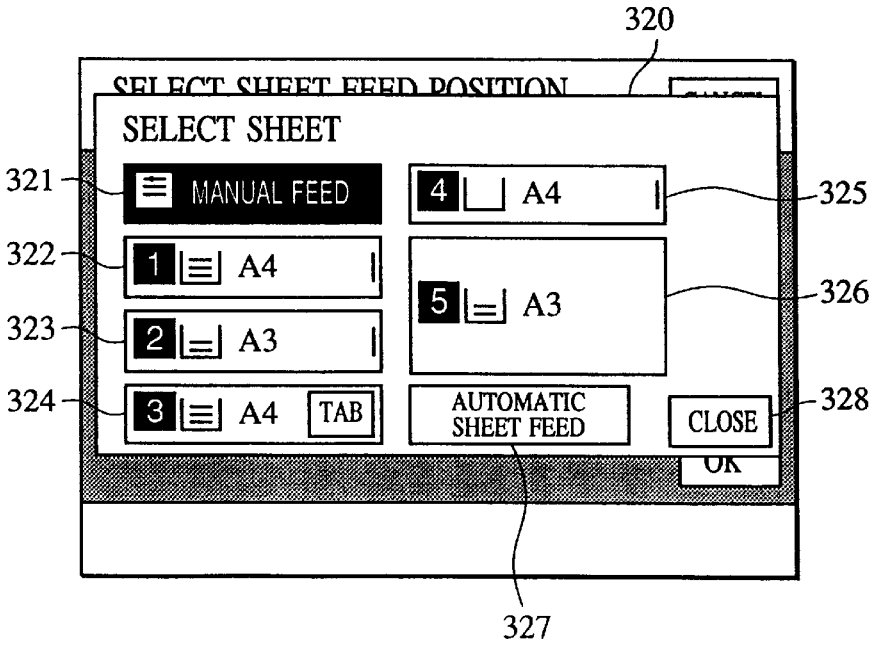
FIG. 9 is a representation showing a subwindow displayed on the LCD, shown in FIG. 3, when a sheet selection key shown in FIG. 8 is depressed.

FIG. 9 is a representation showing a subwindow (sheet selection screen) 320 displayed on the LCD 304, shown in FIG. 3, when the sheet selection key 312 shown in FIG. 8 is depressed. On the sheet selection screen 320, users can designate one of plural candidates of recording sheets, on which an image is to be formed.

Referring to FIG. 9, numerals 321 to 326 denote sheet feed stage selection keys. These keys are used to select and set a desired one of the sheet feed stages, i.e., the right cassette deck 221, the left cassette deck 222, the upper stage cassette 223, the lower stage cassette 224, the deck 250, and the multi-manual feed tray 254, in the main unit 200 of the image forming apparatus shown in FIG. 2. The sheet selection screen 320 is controlled such that the displayed contents reflect the setting information of the tab sheet feed stage entered by users on the above-described tab sheet setting screen shown in FIG. 5. The sheet selection screen 320 shown in FIG. 8 has, by way of example, the contents displayed when the No. 3 cassette (which is assumed to correspond to the cassette 223 shown in FIG. 2) is set as the tab sheet feed stage on the tab sheet setting screen shown in FIG. 5.

In this example, the key 321 corresponds to the multi-manual feed tray 254. The key 322 corresponds to the right cassette deck 221 in which A4 sheets are currently placed. The key 323 corresponds to the left cassette deck 222 in which A3 sheets are currently placed. The key 324 corresponds to the upper stage cassette 223 and displays that it is set as the tab sheet feed stage on the tab-sheet feed stage setting subwindow 1010 shown in FIG. 5. The key 324 also indicates that tab sheets of A4 size are currently placed therein (sheet presence state). By looking at the key 324, therefore, users can recognize on which one of the sheet feed stages tab sheets should be placed, or on which one of the sheet feed stages tab sheets are already placed. In that case, when users select the key 324 and instruct the copy operation to start, the image forming apparatus employs the sheets placed in the cassette 223 that is a sheet feed stage selected by the setting of the tab sheet feed stage.

The key 325 corresponds to the lower stage cassette 224 and indicates that the cassette 224 is currently set for A4 sheets, but no sheets are placed (sheet absence state). The key 326 corresponds to the deck 250 and indicates that A3 sheets are currently placed therein.

Numeral 327 denotes an automatic sheet feed selection key. When the automatic sheet feed is selected upon depression of this key 327, detection of an optimum sheet is automatically performed based on the document size and the set copy mode. If the optimum sheet is not found, a sheet having a size as a second candidate is selected.

Numeral 328 denotes a close key for return to the standard screen 310 shown in FIG. 8.

Figure 10:
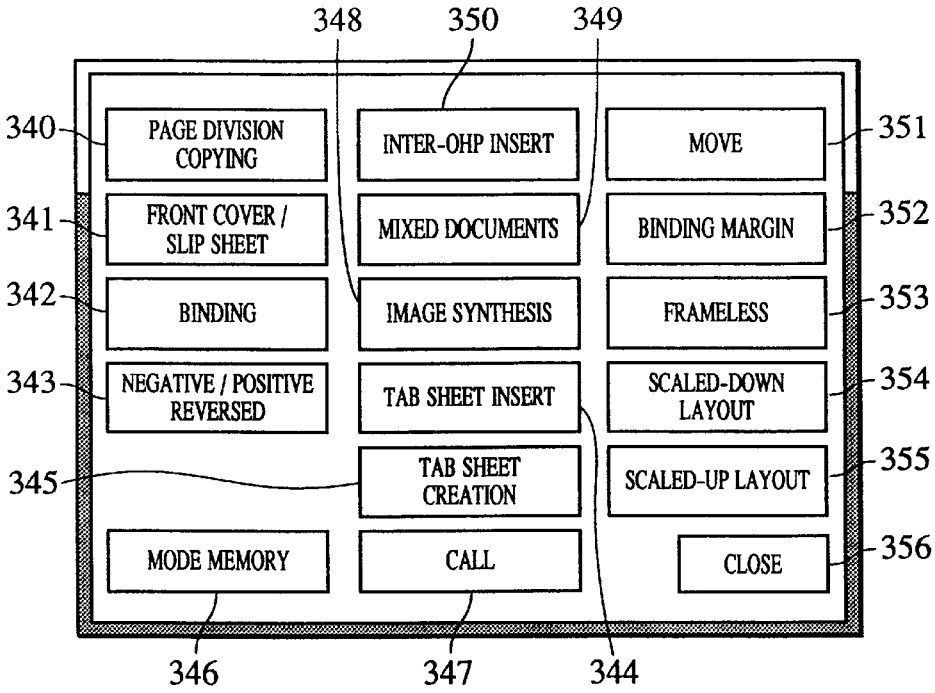
FIG. 10 is a representation showing one example of a subwindow (application mode screen) displayed on the LCD, shown in FIG. 3, when an application mode icon shown in FIG. 8 is depressed.

FIG. 10 is a representation showing one example of a subwindow (application mode screen) displayed on the LCD 304, shown in FIG. 3, when the application mode icon 311 shown in FIG. 8 is depressed. This subwindow displays icons representing the functions of setting various copy modes.

Referring to FIG. 10, numeral 340 denotes a page division copying key for setting the mode in which a document is regarded as a double-spread page and image data of the document is read as two divided documents. Numeral 341 denotes a front-cover/slip-sheet key for setting the mode in which a sheet feed stage for a front cover, a back cover or a slip sheet for partition is selected to output any of those sheets as a part of copies. Numeral 342 denotes a binding mode key for setting the mode in which a document copy is output so as to become a double-spread page of a book when an output sheet is folded at the center. Numeral 343 denotes a negative/positive reversed key for setting the mode in which a white area of a document image is copied black and a black area thereof is copied white.

Numeral 345 denotes a tab sheet creation key for setting the mode in which when the tab sheet feed stage is set as with the upper cassette 223 represented by the key 324 (including display of "tab") shown in FIG. 9, a tab sheet is fed and an image printed on a document and to be formed on a tab is moved to be in match with the tab position (tab area) of the tab sheet and then printed on the tab of the tab sheet. Numeral 344 denotes a tab sheet insertion key for setting the tab sheet insertion mode in which when the tab sheet feed stage is set as with the upper cassette 223 represented by the key 324 (including display of "tab") shown in FIG. 9, a tab sheet is employed as a partition sheet like a slip sheet and an image on a copy document corresponding to the tab of the tab sheet is moved so as to be printed on the tab. Additionally, each of the above two modes includes the mode in which a tab sheet is directly inserted between output sheets without printing an image on the tab sheet, and the mode in which a tab sheet is inserted between output sheets after printing an image on the tab sheet. These modes are optionally selectable by users.

Numeral 346 denotes a mode memory key for storing various mode settings together, such as the application mode, the sorting mode set by the sorter key 316, the zooming mode set by one of the key group 315 shown in FIG. 8, and the image mode set by one of the key group 314 shown in FIG. 8.

Numeral 347 denotes a call key for setting the mode in which the settings made in the previous copying can be called back. Numeral 348 denotes an image synthesis key for setting the mode in which a background image is registered, or a previously registered background image is output while it is superimposed on a document.

Numeral 349 denotes a mixed document key for setting the mode which is executed to make setting when a plurality of documents of A4 and A3 sizes are placed in the automatic document feeder 280 in a mixed way. Numeral 350 denotes an inter-OHP insertion key for setting the mode in which an inter-OHP inserted sheet is inserted between OHP sheets when by OHP sheets are set to be supplied from the multi-manual feed tray 254, by feeding the OHP sheet from the multi-manual feed tray 254 and printing an image on it, while feeding an ordinary sheet from another sheet feed stage and outputting the ordinary sheet subsequent to the OHP sheet after printing the same image on it or without printing no images.

Numeral 351 denotes a movement key for setting the mode which is executed to set how a document image is moved relative to an output sheet. Numeral 352 denotes a binding margin key for setting the mode in which a document image is moved relative to an output sheet to form a binding margin. Numeral 353 denotes a frameless key for setting the mode in which an outer frame of a document image is eliminated, or an outer frame image on a sheet is eliminated in printing.

Numeral 354 denotes a scaled-down layout key for setting the mode in which a plurality of documents are printed on one sheet in a desired layout. Numeral 355 denotes a scaled-up layout key for setting the mode in which a plurality of images created upon depression of the scaled-down layout key 354 to be printed on one sheet, for example, is printed in a division manner. Numeral 356 denotes a close key for closing the application mode subwindow for return to the standard screen 310.

Figure 11:
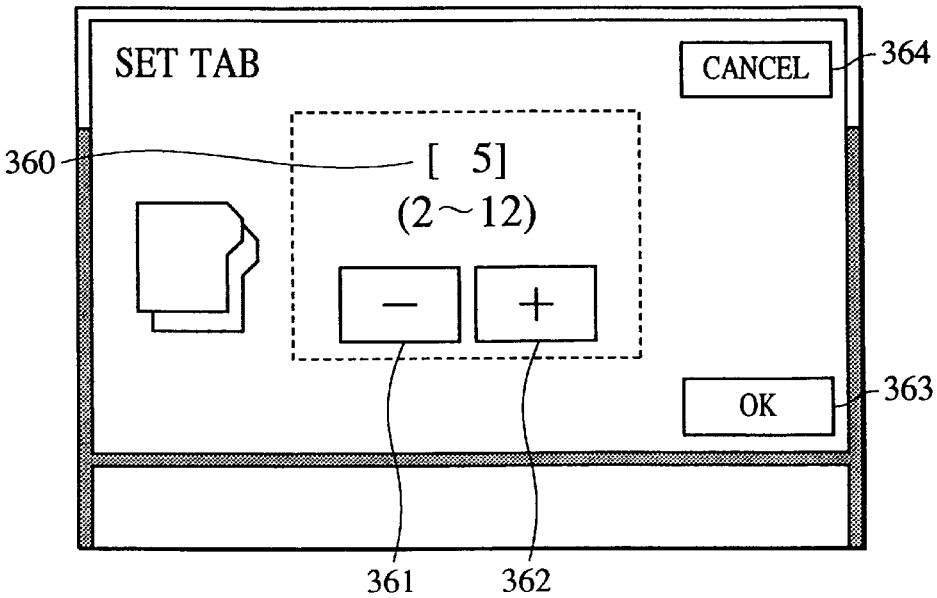
FIG. 11 is a representation showing a subwindow (number-of-tabs setting screen) opened when a tab sheet creation key or a tab sheet insertion key shown in FIG. 10 is depressed.

FIG. 11 shows a subwindow (number-of-tabs setting screen) displayed on the LCD 304 shown in FIG. 3 and opened when the tab sheet creation key 345 or the tab sheet insertion key 344 shown in FIG. 10 is depressed, the subwindow prompting users to enter the number tab divisions.

As shown in FIG. 11, although a general tab sheet is a 5-tab sheet making up one set by five sheets, this embodiment enables the setting to cover from a 2-tab sheet making up one set by two sheets to a 12-tab sheet making up one set by twelve sheets.

Numeral 360 denotes a column indicating the number of divisions which can be increased and decreased using a minus key 361 and a plus key 362. The term "number of divisions" used herein means the number of tab sheets making up one set.

Numeral 363 denotes an OK key for establishing the setting of the number of divisions entered by users. For example, when users enter "5" in the number-of-divisions setting column 360 and depress the OK key 363, the image forming apparatus operates so as to insert five tab sheets, as partition sheets, in one group of output sheets having document images printed thereon. Likewise, when users enter "12" in the number-of-divisions setting column 360 and depress the OK key 363, the image forming apparatus operates so as to insert twelve tab sheets, as partition sheets, in one group of output sheets having document images printed thereon. Thus, tab sheets in number corresponding to a numerical value entered in the number-of-divisions setting column 360 are inserted in a bundle of output sheets. Numeral 364 denotes a cancel key that is depressed for return from the subwindow, on which the number of tab divisions is entered, to the application mode subwindow shown in FIG. 10 without establishing the entered setting.

Figure 12:
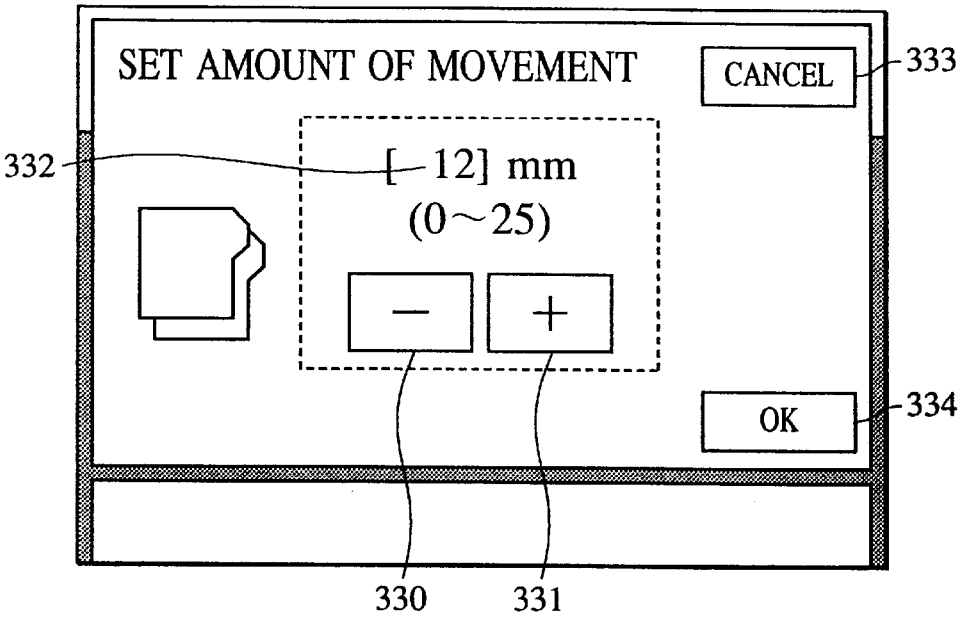
FIG. 12 is a representation showing a subwindow (image movement setting screen) displayed on the LCD, shown in FIG. 3, for setting the amount of image movement after an OK key for the number of tab divisions, shown in FIG. 11, has been depressed.

FIG. 12 shows a subwindow (image movement setting screen) displayed on the LCD 304, shown in FIG. 3, for setting the amount of image movement after the OK key 363 for the number of tab divisions, shown in FIG. 11, has been depressed.

The amount of movement set herein means the amount by which an image should be moved so that the image contained in a document and to be printed on a tab is surely printed on the tab. For a tab sheet of A4 size, it is usually enough to move the tab sheet through about 12 mm, but the amount of movement actually required varies depending on the character size printed on the tab and the image position on a document. In this embodiment, therefore, the amount of movement can be set over the range of 0 mm to 25 mm.

Numeral 332 denotes an amount-of-movement display column for displaying the amount of movement that is now to be set. An initial value is the usual amount of movement, i.e., 12 mm.

Numeral 330 denotes a minus key for decreasing the amount of movement displayed in the amount-of-movement display column 322, and numeral 331 denotes a plus key for increasing the amount of movement. Numeral 333 denotes a cancel key that is depressed to cancel the setting of the amount of movement and make return to the entry screen of FIG. 11, on which the number of tab divisions is entered. Numeral 334 denotes an OK key for establishing the value displayed in the amount-of-movement setting column 332 to be reflected in printing. For example, when users enter "12" mm in the amount-of-movement setting column 332 and depress the OK key 334, the image forming apparatus operates to print an image on a tab sheet such that an image read from a document, which contains the image to be printed on the tab sheet, is shifted 12 mm toward the tab.

Figure 13:
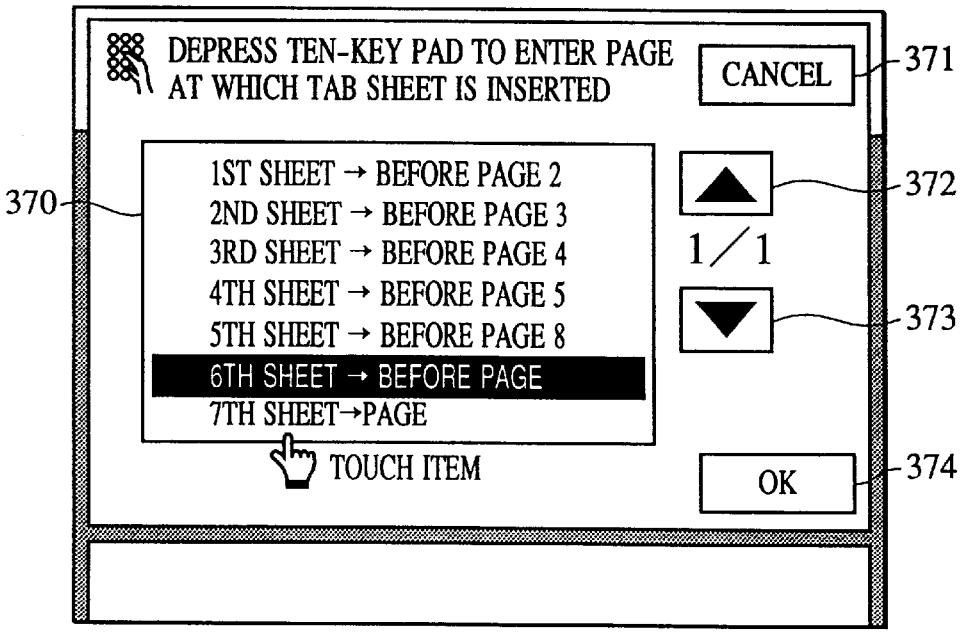
FIG. 13 is a representation showing a subwindow (tab-sheet inserted page setting screen) displayed on the LCD, shown in FIG. 3, for setting the page number, before which a tab sheet is to be inserted, after an OK key shown in FIG. 12 has been depressed.

Next, in the tab sheet insertion mode, the page number, before which a tab sheet is to be inserted, is set on tab-sheet inserted page setting screen shown in FIG. 13.

FIG. 13 shows a subwindow (tab-sheet inserted page setting screen) displayed on the LCD 304, shown in FIG. 3, for setting the page number, before which a tab sheet is to be inserted, after the OK key 334 shown in FIG. 12 has been depressed. On the subwindow of FIG. 13, users designate tab-sheet inserted positions, i.e., before which pages of a bundle of output sheets tab sheets in number set on the subwindow of FIG. 11 are inserted, for each tab sheet.

Referring to FIG. 13, numeral 370 denotes an inserting page window that display pages at which a tab sheet is inserted. When setting a first tab sheet, users select a column corresponding to the first tab sheet (sixth tab sheet is selected in an example of FIG. 13), and enter the page number, before which the first tab sheet is to be inserted, using the ten-digit key pad 301 shown in FIG. 3. In the illustrated example, the first tab sheet is set to be inserted before a second page of text of output document copies.

Likewise, in the example of FIG. 13, user setting is performed such that a second tab sheet is inserted before a third page of the output document copies, a third tab sheet is inserted before a fourth page thereof, a fourth tab sheet is inserted before a fifth page thereof, and a fifth tab sheet is inserted before an eighth page thereof.

Numeral 371 denotes a cancel key that is depressed to cancel the page numbers, before which the tab sheets are to be inserted, and make return to the subwindow for setting the amount of image movement on a tab sheet (i.e., the amount-of-image-movement setting screen of FIG. 12). Numeral 372 denotes a key for scrolling up the inserting page window 370 when the number of pages, at which the tab sheets are inserted, is seven or more. Numeral 373 denotes a key for scrolling down the inserting page window 370 when the number of pages, at which the tab sheets are inserted, is seven or less.

Numeral 374 denotes an OK key for establishing the page number, before which a tab sheet is to be inserted, set on the inserting page window to be reflected in the copy job. The setting of the tab sheet insertion mode is completed upon depression of the OK key 374.

The setting information (including data with regard to the number of tab divisions, the amount of movement of a tab-sheet image, and the tab-sheet inserted positions) entered on the setting screens, shown in FIGS. 11 to 13, is stored and held in a memory as information to be used in the tab sheet output mode.

As described above with reference to FIGS. 11 to 13, at what position in one set of output copies a tab sheet is inserted, what is the amount of movement of an image to be printed in a tab, and at which page a tab sheet is fed, are decided in the copy job in accordance with the tab-sheet setting information (including the number of tab divisions, the amount of movement of a tab-sheet image, and the tab-sheet inserted pages) set on the setting screens shown in FIGS. 11 to 13.

When the number of divisions, the amount of movement, and the inserted positions are set, by way of example, as shown in FIGS. 11 to 13, five tab sheets are inserted in one group of output sheets.

A description is now made in connection with an example of practical operation. The image forming apparatus of this embodiment is assumed to be an apparatus of the page ascending type in which input images are processed successively from a first page, and of the facedown mode type in which sheets are ejected and stacked such that sheet surfaces having images formed thereon face downward. It is also assumed that the total number of text pages of input document images is eight.

First, one of document images for a first page of a text made up of eight pages is printed on a sheet (e.g., a ordinary sheet or an OHP sheet), which has the media type different from a tab sheet and is supplied from a container (in this example, any cassette other than the cassette 223 shown in FIG. 2) where no tab sheets are contained. The first document copy sheet is then ejected onto the sheet ejection tray.

Then, a first one of tab sheets making up one set by five sheets is supplied from the cassette 223. A tab-sheet image to be formed on the first tab sheet is printed on a tab of the first tab sheet while it is shifted 12 mm toward the tab. The printed first tab sheet is ejected onto the document copy sheet, which is already put on the sheet ejection tray and has the document image of the first text page printed thereon.

Subsequently, another document image for a second page of the text is printed on another sheet, which has the media type different from the tab sheet and is supplied from the container other than the cassette 223 shown in FIG. 2. The second document copy sheet is then ejected onto the first printed tab sheet already put on the sheet ejection tray.

Then, a second one of the tab sheets making up one set by five sheets is supplied from the cassette 223. A tab-sheet image to be formed on the second tab sheet is printed on a tab of the second tab sheet while it is shifted 12 mm toward the tab. The printed second tab sheet is ejected onto the document copy sheet, which is already put on the sheet ejection tray and has the document image of the second text page printed thereon.

Subsequently, still another document image for a third page of the text is printed on still another sheet, which has the media type different from the tab sheet and is supplied from the container other than the cassette 223 shown in FIG. 2. The third document copy sheet is then ejected onto the second printed tab sheet already put on the sheet ejection tray.

Then, a third one of the tab sheets making up one set by five sheets is supplied from the cassette 223. A tab-sheet image to be formed on the third tab sheet is printed on a tab of the third tab sheet while it is shifted 12 mm toward the tab. The printed third tab sheet is ejected onto the document copy sheet, which is already put on the sheet ejection tray and has the document image of the third text page printed thereon.

Subsequently, still another document image for a fourth page of the text is printed on still another sheet, which has the media type different from the tab sheet and is supplied from the container other than the cassette 223 shown in FIG. 2. The fourth document copy sheet is then ejected onto the third printed tab sheet already put on the sheet ejection tray.

Then, a fourth one of the tab sheets making up one set by five sheets is supplied from the cassette 223. A tab-sheet image to be formed on the fourth tab sheet is printed on a tab of the fourth tab sheet while it is shifted 12 mm toward the tab. The printed fourth tab sheet is ejected onto the document copy sheet, which is already put on the sheet ejection tray and has the document image of the fourth text page printed thereon.

Subsequently, still another document image for a fifth page of the text is printed on still another sheet, which has the media type different from the tab sheet and is supplied from the container other than the cassette 223 shown in FIG. 2. The fifth document copy sheet is then ejected onto the fourth printed tab sheet already put on the sheet ejection tray.

Thereafter, still another document image for a sixth page of the text is printed on still another sheet, which has the media type different from the tab sheet and is supplied from the container other than the cassette 223 shown in FIG. 2. The sixth document copy sheet is then ejected onto the fifth document copy sheet, which is already put on the sheet ejection tray and has the document image of the fifth text page printed thereon. Subsequently, still another document image for a seventh page of the text is printed on still another sheet, which has the media type different from the tab sheet and is supplied from the container other than the cassette 223 shown in FIG. 2. The seventh document copy sheet is then ejected onto the sixth document copy sheet, which is already put on the sheet ejection tray and has the document image of the sixth text page printed thereon.

Then, a fifth one of the tab sheets making up one set by five sheets is supplied from the cassette 223. A tab-sheet image to be formed on the fifth tab sheet is printed on a tab of the fifth tab sheet while it is shifted 12 mm toward the tab. The printed fifth tab sheet is ejected onto the document copy sheet, which is already put on the sheet ejection tray and has the document image of the seventh text page printed thereon. The insertion of all the tab sheets into the set of documents is completed at this time.

Finally, still another document image for an eighth page of the text is printed on still another sheet, which has the media type different from the tab sheet and is supplied from the container other than the cassette 223 shown in FIG. 2. The eighth document copy sheet is then ejected onto the fifth printed tab sheet already put on the sheet ejection tray. In this example, since no succeeding pages of input documents exist any more, the copy processing is now ended. If any succeeding input page exists, the copy processing is repeated to print document images successively until input pages are all output.

In the tab sheet insertion mode, as described above, tab sheets are inserted before pages, designated by users, in accordance with the tab-sheet setting information, the setting information of the tab sheet feed stage, etc., which have been set on the setting screens shown in FIGS. 11 to 13.

The setting data is stored in a nonvolatile memory as a part of the internal RAM (not shown) of the main unit controller 100 shown in FIG. 1.

A description is now made of the case where the tab sheet feed stage is set on the setting screens shown in FIGS. 4 and 5, and the inter-OHP insertion key 350 is selected on the application mode screen shown in FIG. 10.

First, when the application mode key 305 in the operation panel shown in FIG. 3 is depressed by users, the application mode screen shown in FIG. 10 is displayed on the LCD 304. Then, when the inter-OHP insertion key 350 on the screen of FIG. 10 is selected by users, an OHP sheet-size selection screen shown in FIG. 14, described below, is displayed on the LCD 304 (the display contents on the LCD 304 are changed over from the screen of FIG. 10 to the screen of FIG. 14).

Figure 14:
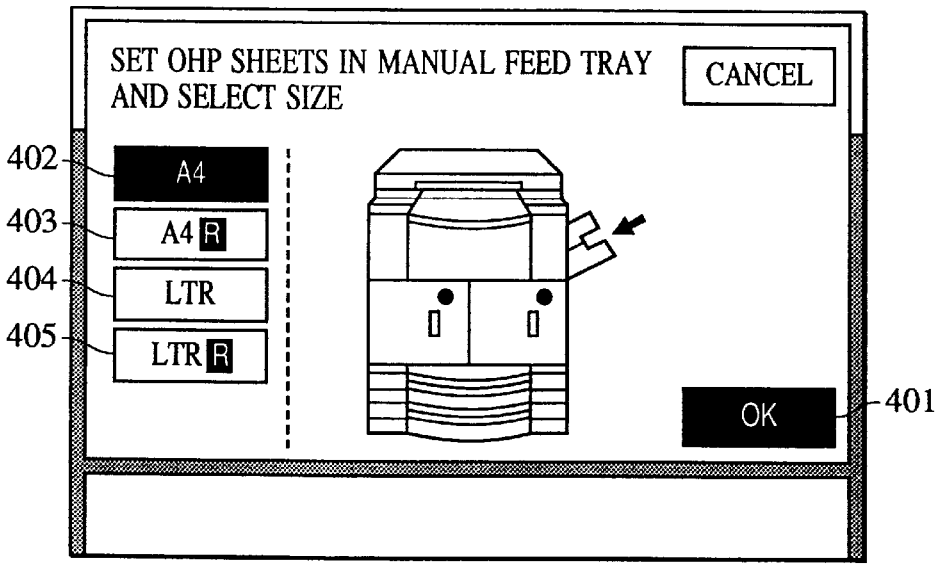
FIG. 14 is a representation showing one example of an OHP sheet-size selection screen displayed on the LCD, shown in FIG. 3, after an inter-OHP insertion key shown in FIG. 10 has been depressed.

FIG. 14 shows one example of the OHP sheet-size selection screen displayed on the LCD 304, shown in FIG. 3, after the inter-OHP insertion key 350 shown in FIG. 10 has been depressed. This screen prompts users to place OHP sheets on the multi-manual feed tray 254 and to select the size of the OHP sheets.

Following the guidance on the screen of FIG. 14, users place OHP sheets on the multi-manual feed tray 254, and designates the size of the OHP sheets placed on the tray 254 by depressing any of keys 402 to 405 corresponding to sizes A4, A4R, LTR and LTRR, respectively. Then, upon an OK key 401 being depressed, the display contents on the LCD 304 are changed over to a screen shown in FIG. 15 described below.

Figure 15:
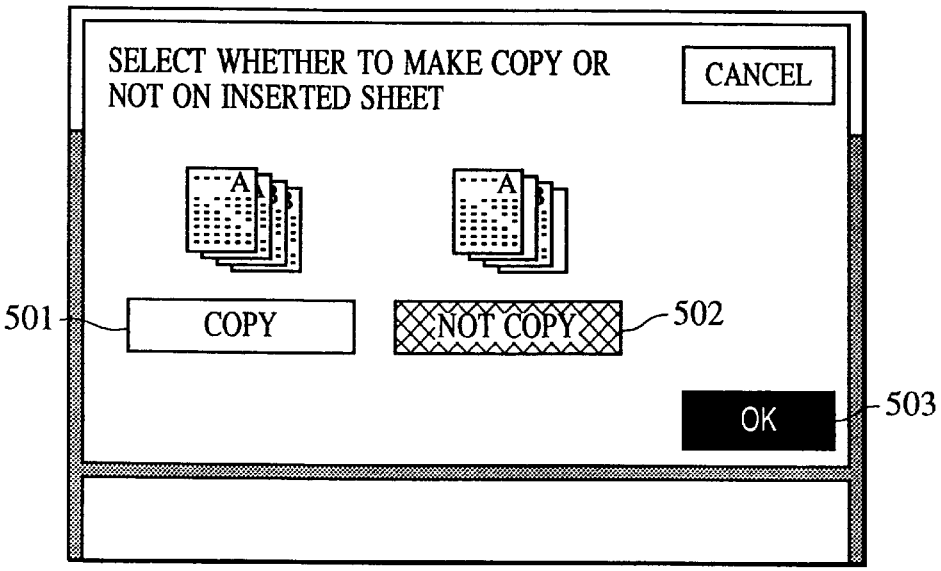
FIG. 15 is a representation showing one example of a screen (copy-on-inserted-sheet setting screen) displayed on the LCD for setting whether to make copy on an inserted sheet or not, when an OK key shown in FIG. 14 is depressed.

FIG. 15 shows one example of a screen (copy-on-inserted-sheet setting screen) displayed on the LCD 304 for setting whether to make copy on an inserted sheet or not, when the OK key shown in FIG. 14 is depressed.

When users select a "copy" button 501 and depress an OK key 503 on the screen of FIG. 15, an inserted sheet is ejected after an image has been printed on it. On the other hand, when users select a "not copy" button 502 and depress the OK key 503, an inserted sheet is ejected without copying any image on it.

When the tab sheet feed stage is not set on the tab-sheet feed stage setting screen 1012 shown in FIG. 5, the display control is performed such that the screen for setting whether to make copy on an inserted sheet or not, shown in FIG. 15, is opened in the state where the "copy" button 501 is selected by default. On the other hand, when the tab sheet feed stage is set, the display control is performed such that the screen for setting whether to make copy on an inserted sheet or not is opened, as shown in FIG. 15, in the state where the "not copy" button 502 is selected (indicated by hatching) by default.

The reason is that, because a tab sheet is more expensive than an ordinary sheet, "not copy" is selected as the default (initial) setting as to whether to make copy or not, allowing the tab sheet to be used plural times without printing.

More specifically, for example, when "copy" is always selected by default regardless of the setting contents, there may occur a disadvantage in that if users are not aware of the above setting, an image is copied on a tab sheet, as an inserted sheet, contrary to the user's intent.

While the default setting in the screen of FIG. 15 differs between when the tab sheet feed stage is set and when it is not set, this embodiment is arranged such that, in either case, users are able to select "copy" or "not copy" by depressing the button 501 or 502.

Thus, when a tab sheet can be designated as an inserted sheet, the mode of not forming an image on the inserted sheet is set by default on the setting screen to decide whether an image is formed on the inserted sheet. Also, when a tab sheet cannot be designated as an inserted sheet, the mode of forming an image on the inserted sheet is set by default on the setting screen to decide whether an image is formed on the inserted sheet.

The setting data entered on the screens of FIGS. 14 and 15 is stored in the internal RAM (not shown) of the main unit controller 100 shown in FIG. 1.

Figure 16:
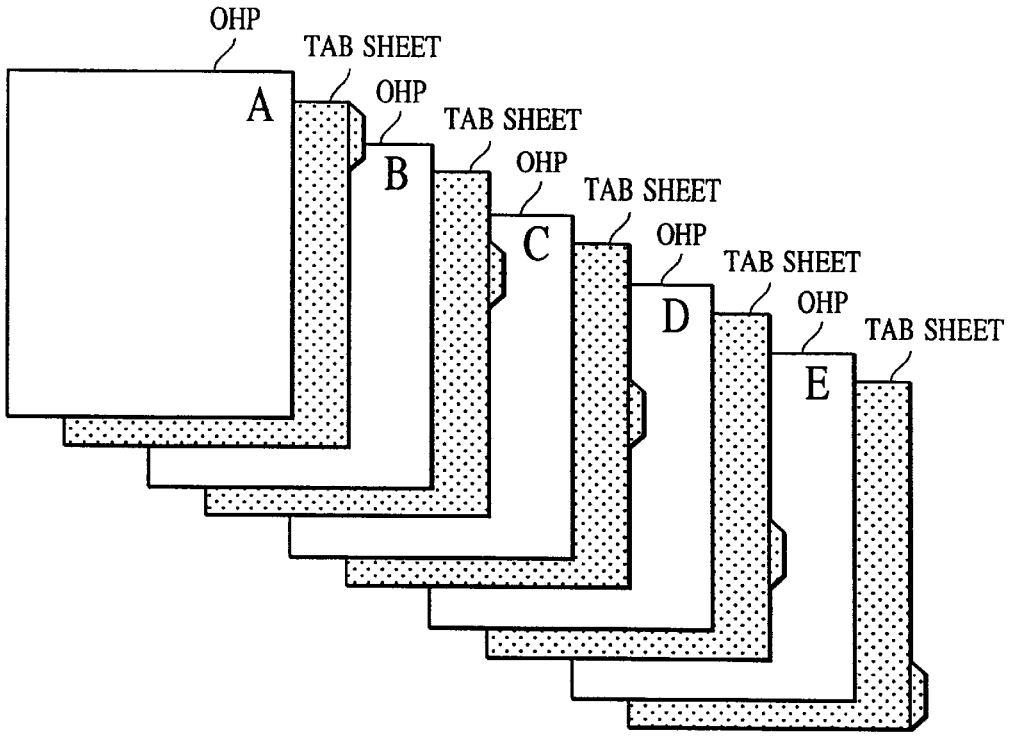
FIG. 16 is an illustration showing an output result corresponding to the case where the setting not to copy an image on an inserted sheet is made on the screen shown in FIG. 15.

In this way, in accordance with the screens of FIGS. 14 and 15, the OHP sheets are placed on the manual feed tray, and the size setting of the OHP sheets and the setting as to whether to copy an image on the inserted sheet are made. Then, when the start key 303 shown in FIG. 3 is depressed, a document image is read, one OHP sheet is supplied from the manual feed tray, and one tab sheet having the same size as the OHP sheet is automatically supplied from the set tab sheet feed stage. The above steps are repeated alternately, whereby copies are output as shown in FIG. 16.

Stated otherwise, in response to the selection of the inter-OHP insertion mode, the image forming apparatus is controlled such that a tab sheet is automatically supplied, as an inserted sheet, from the sheet feed stage, which has been set to the tab sheet feed stage, without requiring users to perform an additional operation of designating, e.g., the type of inserted sheet.

The term "inter-OHP inserting function" used herein means the mode of inserting another type of sheet between OHP sheets, i.e., the mode of outputting one sheet of another type each time one OHP sheet is output.

In the inter-OHP inserting function, therefore, even when tab sheets are automatically selected as sheets to be inserted between OHP sheets, at what positions the tab sheets are to be inserted are determined beforehand. Hence, users are not required to designate the tab-sheet inserted positions on the setting screen of FIG. 13, which is displayed upon the users selecting the tab-sheet insertion mode (key 344) or the tab-sheet creation mode (key 345) on the screen of FIG. 10.

Accordingly, in this embodiment, when the inter-OHP insertion mode is selected upon the inter-OHP insertion key 350 being depressed by users on the screen of FIG. 10 and tab sheets are used as inserted sheets, the image forming apparatus is controlled so as not to display the setting screen for designating the tab-sheet inserted positions, shown in FIG. 13, which is displayed upon the users selecting the tab-sheet insertion mode (key 344) or the tab-sheet creation mode (key 345) on the screen of FIG. 10. Then, without requiring the users to designate the tab-sheet inserted positions, the copy processing is controlled such that the tab sheets are each inserted between OHP sheets (one OHP sheet and one tab sheet are alternately output). As a result, it is possible to avoid erroneous operations by users to the utmost, and improve convenience in operability for users.

FIG. 16 is an illustration showing an output result corresponding to the case where the inter-OHP insertion mode is selected upon the key 350 being depressed by users on the application mode setting screen of FIG. 10 and the setting not to copy an image on an inserted sheet is made on the screen shown in FIG. 15 (i.e., the default setting remains effective).

In this embodiment, as described above, in response to the selection of the inter-OHP insertion mode, the image forming apparatus is controlled such that a tab sheet is automatically selected as an inserted sheet and inserted between OHP sheets. Further, when the tab sheet is used as the inserted sheet in inter-OHP insertion mode, the copy processing is controlled so as to insert each tab sheet between OHP sheets without requiring users to designate the tab-sheet inserted positions.

The operation of the image forming apparatus according to the first embodiment of the present invention will be described below with reference to a flowchart shown in FIG. 17.

Figure 17:
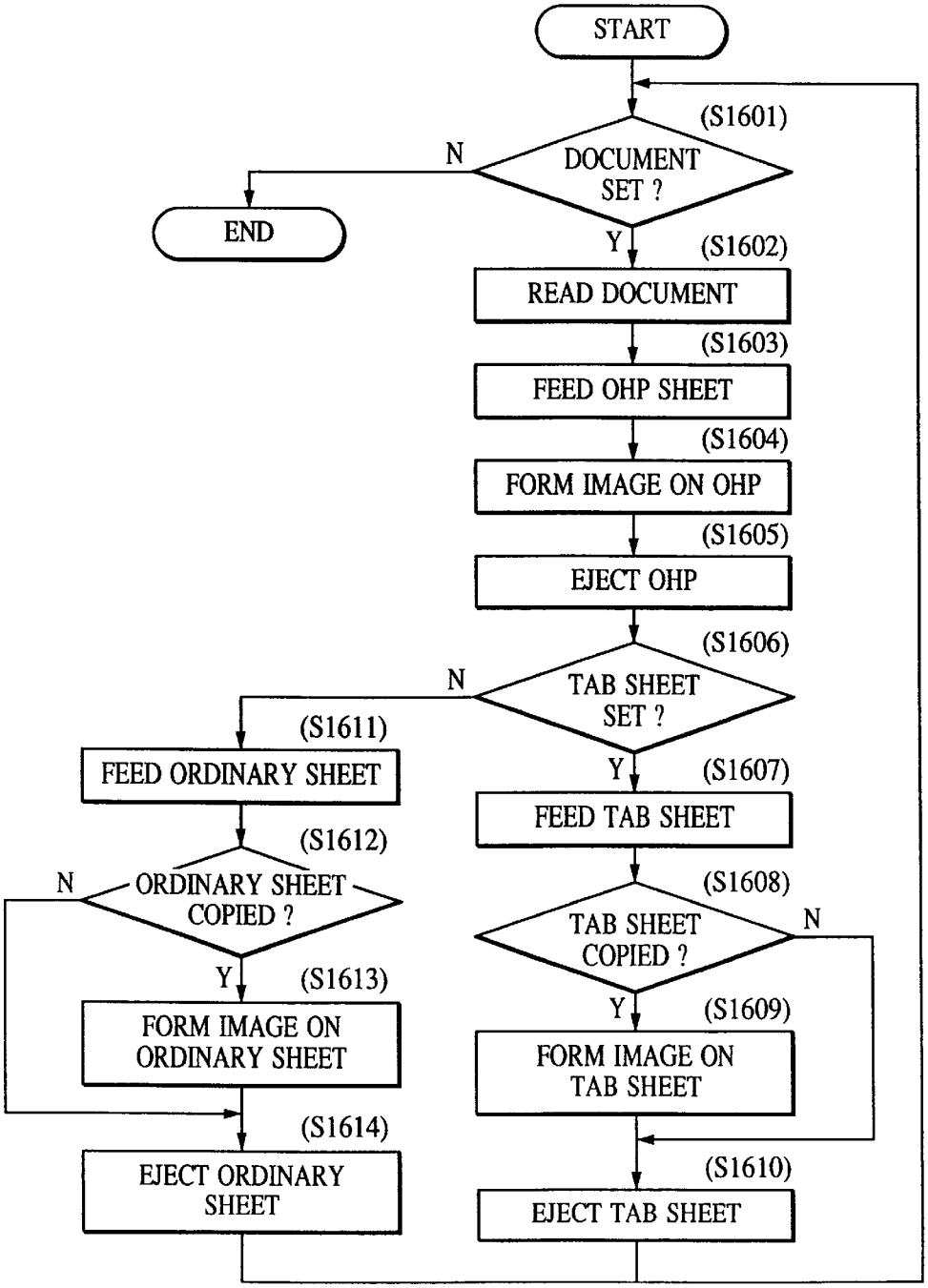
FIG. 17 is a flowchart showing one example of a first control processing procedure in the image forming apparatus of the present invention.

FIG. 17 is a flowchart showing one example of a first control processing procedure in the image forming apparatus of the present invention. This procedure represents the processing executed upon the copy start key 302 being depressed after the tab sheet feed stage is set beforehand on the tab-sheet feed stage setting screen 1012 shown in FIG. 5 (or when the media type is designated for each sheet feed stage and the media type information for each sheet feed stage is managed together with the sheet size information and the sheet presence/absence information), and after the inter-OHP insertion mode (key 350) is selected on the application mode screen of FIG. 10.

It is here assumed that an input from the copy start key 302 is accepted only when there is an ordinary sheet or a tab sheet having the same size as an OHP sheet, and the number of output copy is one. The flowchart of FIG. 17 is executed by the CPU (not shown), which is incorporated in the main unit controller 100 shown in FIG. 1, in accordance with a program stored in the ROM (not shown) or another storage medium. S1601 to S1614 represent successive steps.

First, whether a document to be read still remains is determined by a sensor (not shown) associated with the document reader 118 shown in FIG. 1 or the ADF 280 shown in FIG. 2 (S1601). If one or more documents still remain, image data of one document is read (S1602), and an OHP sheet is supplied from the multi-manual feed tray 254 (S1603). An image is formed on the supplied OHP sheet based on the read image data of the document (S1604), and the OHP sheet having the image formed thereon is ejected (S1605).

Next, the CPU determines whether tab sheets are present on the sheet feed stage that has been set as the tab sheet feed stage on the tab-sheet feed stage setting screen (subwindow) 1010 shown in FIG. 5 (S1606). If tab sheets are present, the tab sheet is supplied from the set tab sheet feed stage (S1607), and the CPU determines whether "copy" is selected on the screen, shown in FIG. 15, for setting whether to copy an image on an inserted sheet or not (S1608). If "copy" is selected, an image is formed on the tab sheet based on the read image data of the document (S1609). If "copy" is not selected in step S1608, the tab sheet is ejected without forming an image on it (S1610).

On the other hand, if the determination of the tab sheet feed stage in step S1606 is not satisfied (i.e., if the setting of the tab sheet feed stage is not made or if sheets are not present in the sheet feed stage set as the tab sheet feed stage), an ordinary sheet having the same size as the OHP sheet is supplied (S1611). Then, the CPU determines whether "copy" is selected on the screen, shown in FIG. 15, for setting whether to copy an image on an inserted sheet or not (S1612). If "copy" is selected, an image is formed on the supplied ordinary sheet based on the read image data of the document (S1613). If "copy" is not selected in step S1612, the supplied ordinary sheet is ejected without forming an image on it (S1614).

After ejection of the inserted sheet in step S1610 or S1614, the CPU returns to step S1601 and repeats the processing of steps S1601 to S1614 until there is no longer a document to be read in step S1601 (i.e., until all documents images are completely read). The processing is ended upon detection of no more documents to be read.

Through the processing described above, when tab sheets are placed in a sheet feed stage, the sheet feed stage containing the tab sheets is automatically selected in the inter-OHP insertion mode. Therefore, the tab sheets can be each automatically inserted between OHP sheets without requiring users to perform a troublesome separate operation for additionally setting the sheet feed stage, on which the tab sheets are placed, as the sheet feed stage for inserted sheets to.

(Second Embodiment)

The above first embodiment is intended to provide the arrangement that, when tab sheets are placed in a sheet feed stage, the sheet feed stage containing the tab sheets is automatically selected in the inter-OHP insertion mode. The arrangement may be modified to make it possible to set whether the OHP page number or the like is printed on a tab of a tab sheet supplied in the inter-OHP insertion mode. An embodiment having such a modified arrangement will be described below.

An image forming apparatus of this second embodiment is assumed to have the same control system as that in the first embodiment.

This second embodiment represents the case being able to select whether the OHP page number is printed on a tab of a tab sheet, when the "copy" button 502 is selected on the screen, shown in FIG. 15, for setting whether to copy an image on an inserted sheet or not and the OK key 503 is depressed, after setting the tab sheet feed stage and selecting the inter-OHP insertion key 350 on the application mode screen of FIG. 10.

Figure 18:
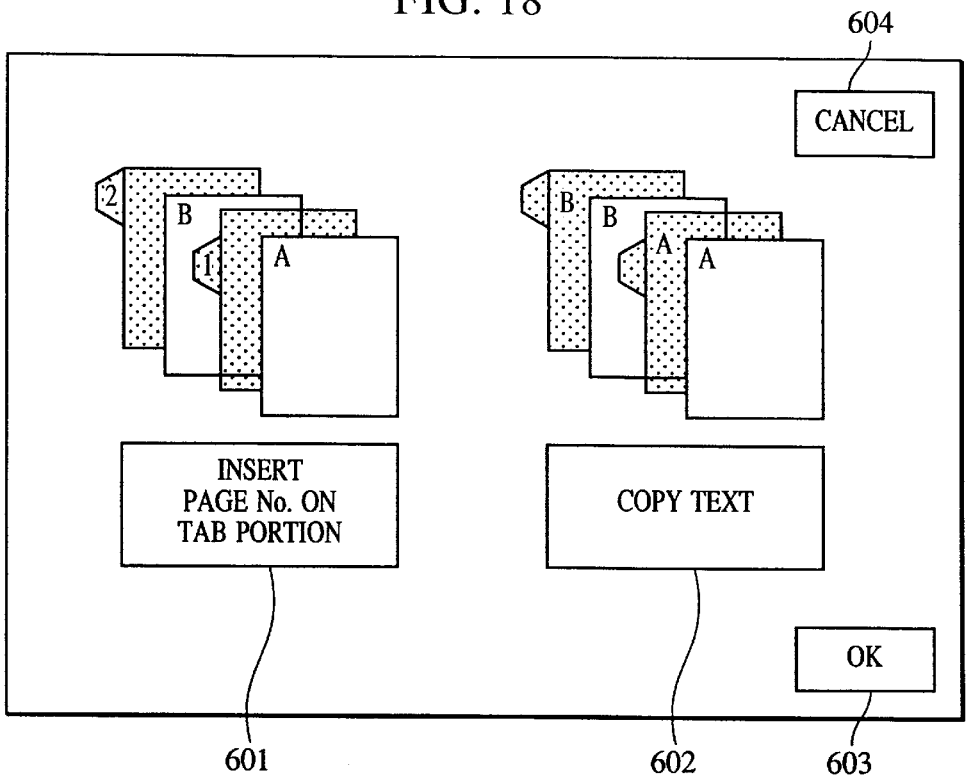
FIG. 18 is a representation showing one example of an OHP-associated tab-sheet information print setting screen on which users can select whether to print information associated with an OHP sheet on a tab of a tab sheet or not (whether to print the page number or a text on the tab sheet in the example).

When the "copy" button 502 is selected on the screen, shown in FIG. 15, for setting whether to copy an image on an inserted sheet or not and the OK key 503 is depressed, an OHP-associated tab-sheet information print setting screen shown in FIG. 18 is displayed if tan sheets having the same size as OHP sheets set on the screen of FIG. 14 are placed on the sheet feed stage.

FIG. 18 is a representation showing one example of an OHP-associated tab-sheet information print setting screen on which users can select whether to print information associated with an OHP sheet on a tab of a tab sheet or not (whether to print the page number or a text on the tab sheet in the example), the screen being displayed on the LCD 304 shown in FIG. 3.

Referring to FIG. 18, numeral 601 denotes a page number insertion button. Upon selection of the page number insertion button 601, the page number can be printed on a tab of a tab sheet to be inserted between OHP sheets. Numeral 602 denotes a text copy button. Upon selection of the text copy button 602, the same image as that copied on an OHP sheet is copied on a tab sheet (except its tab). The page number insertion button 601 and the text copy button 602 can be selected at the same time. Numeral 604 denotes a cancel button. Upon selection of the cancel button 604, the screen returns to the screen, shown in FIG. 15, for setting whether to copy an image on an inserted sheet or not. Note that the setting data entered on the screens of FIG. 18 is stored in the internal RAM (not shown) of the main unit controller 100 shown in FIG. 1.

For example, when the start key 302 shown in FIG. 3 is depressed after selecting the page number insertion button 601 and depressing an OK button 603, a document image is read, and one OHP sheet is supplied from the multi-manual feed tray 254. Then, one tab sheet having the same size as the OHP sheet is automatically supplied from the set tab sheet feed stage, and the page number is printed on a tab of the tab sheet. The above steps are repeated alternately, whereby copies are output as shown in FIG. 19.

Figure 19:
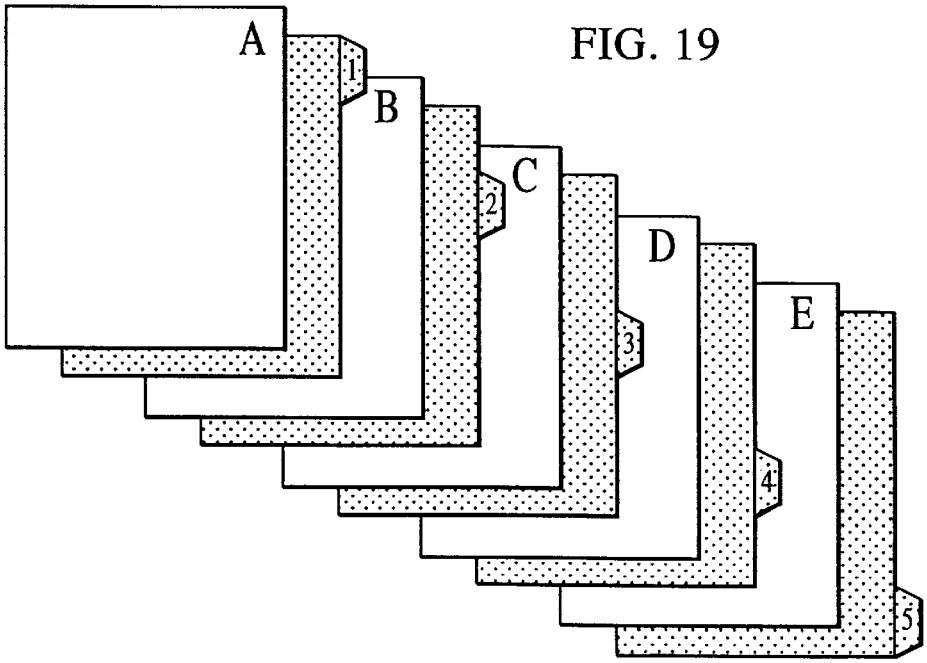
FIG. 19 is an illustration showing one example of an output result corresponding to the case where the setting to copy an image on an inserted sheet is made on the screen shown in FIG. 15 and the setting to print the information (page number in the example) associated with the OHP sheet on the tab of the tab sheet, which is used as the inserted sheet, is made on the OHP-associated tab-sheet information print setting screen shown in FIG. 18.

FIG. 19 is an illustration showing one example of an output result corresponding to the case where the setting to copy an image on an inserted sheet is made on the screen shown in FIG. 15 and the setting to print the information (page number in the example) associated with the OHP sheet on the tab of the tab sheet, which is used as the inserted sheet, is made on the OHP-associated tab-sheet information print setting screen shown in FIG. 18.

As seen from FIG. 19, the page number is printed on the tab of the tab sheet ejected as the inserted sheet.

The operation of the image forming apparatus according to the second embodiment of the present invention will be described below with reference to a flowchart shown in FIG. 20.

Figure 20:
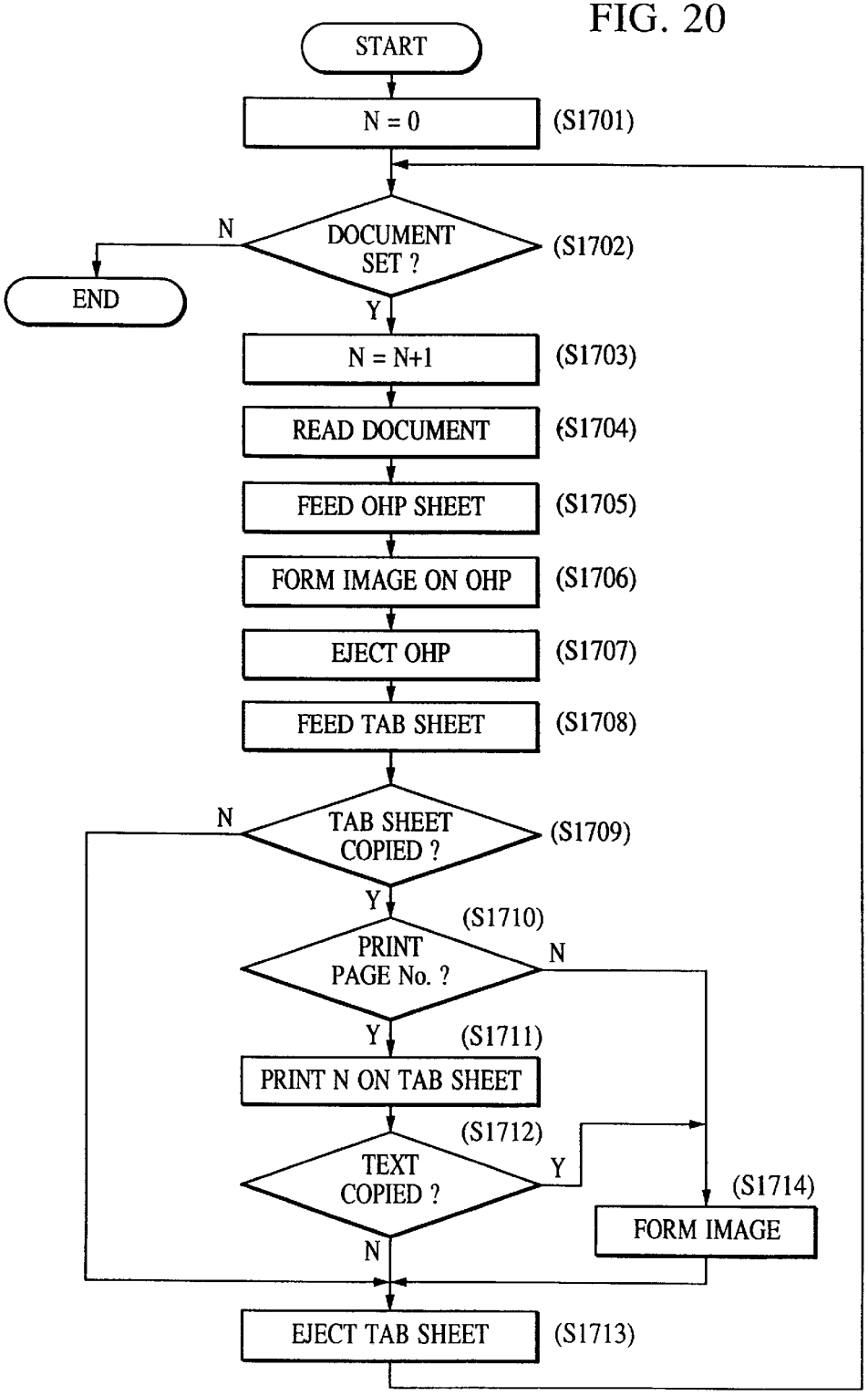
FIG. 20 is a flowchart showing one example of a second control processing procedure in the image forming apparatus of the present invention.

FIG. 20 is a flowchart showing one example of a second control processing procedure in the image forming apparatus of the present invention. This procedure represents the processing executed upon the copy start key 302 being depressed after the tab sheet feed stage is set and the inter-OHP insertion mode is selected on the application mode screen of FIG. 10. The flowchart of FIG. 20 is executed by the CPU (not shown), which is incorporated in the main unit controller 100 shown in FIG. 1, in accordance with a program stored in the ROM (not shown) or another storage medium. S1701 to S1714 represent successive steps.

First, a variable N for counting the number of documents is initialized (S1701).

Then, whether a document to be read still remains is determined by a sensor (not shown) associated with the document reader 118 shown in FIG. 1 or the ADF 280 shown in FIG. 2 (S1702). If one or more documents still remain in step S1702, the variable N is incremented by one (S1703) and image data of one document is read (S1704). Subsequently, an OHP sheet is supplied from the multi-manual feed tray 254 (S1705). An image is formed on the OHP sheet, supplied in step S1705, based on the read image data of the document (S1706), and the OHP sheet having the image formed thereon is ejected (S1707).

Next, a tab sheet is supplied from the tab sheet feed stage (S1708), and the CPU determines whether "copy" is selected on the screen, shown in FIG. 15, for setting whether to copy an image on an inserted sheet or not (S1709). If "copy" is selected, the CPU determines whether to print the page number on a tab of the tab sheet (S1710). If the setting to print the page number on the tab is determined, the same numeral as the variable N is printed, as the page number of the OHP sheet, on the tab of the supplied tab sheet (S1711).

Then, the CPU determines in step S1712 whether the setting to copy a text, i.e., the read image data of the document, on the tab sheet is made. If the setting to copy a text on the tab sheet is made, the read image data of the document is copied on the tab sheet (namely, a text image is formed) (S1714), and the tab sheet having the image formed thereon is ejected (S1713).

On the other hand, if the setting not to copy a text on the tab sheet is determined in step S1712, the tab sheet is directly ejected (S1713).

Also, if the setting not to print the page number on the tab is determined in step S1710, the read image data of the document is copied on the tab sheet (namely, the text image is formed) (S1714), and the tab sheet having the image formed thereon is ejected (S1713).

Further, if the setting not to copy an image on the tab sheet is determined in step S1709, the tab sheet is directly ejected (S1713).

After ejection of the tab sheet in step S1713, the CPU returns to step S1702 and repeats the processing of steps S1702 to S1714 until there is no longer a document to be read in step S1702 (i.e., until all documents images are completely read). The processing is ended upon detection of no more documents to be read.

This embodiment has been described in connection with the case where the inter-OHP insertion mode is selected through the operation panel 119 shown in FIG. 3 and the read document image is copied on a sheet. However, image data from a host computer may also be recorded in a similar manner. More specifically, a printer driver in the host computer may designate the inter-OHP insertion mode and select the sheet feed stage for inserted sheets as the tab-sheet feed stage. In such a case, the printer driver is arranged to be able to select whether the page number is printed on a tab, and whether the title name of each page of image data is printed on a tab sheet. Then, an image is printed on the tab sheet, as the inserted sheet, in accordance with the page information, the title information, the information regarding whether to print the page number on a tab or not, and the information regarding whether to print the title name or not, which are sent from the host computer. The printed tab sheet is then output. Thus, it is also possible to make the setting of the inter-OHP insertion function and the setting of tab sheets on the host computer side, to output the setting information to the image forming apparatus along with document image data, and to perform control necessary for the tab sheets in the inter-OHP inserting function based on the setting information on the side of the image forming apparatus.

In this embodiment, it is assumed that an image forming section dedicated for a tab is not provided, and the image forming section 210 shown in FIG. 2 is used to make printing on a tab. Then, when printing of the page number or the like on a tab and text copy are both designated, the image forming section 210 combines an image of the page number printed on a tab and an image of the text copy, and transfers the combined image onto a tab sheet at a time. However, the page number may be first printed on a tab, and thereafter a text may be copied on a tab sheet by feeding the tab sheet through the sheet re-feed path again.

As an alternative, in addition to the image forming section 210 shown in FIG. 2, an image forming section dedicated for a tab may be provided separately.

Through the processing described above, an image forming apparatus can be provided in which when tab sheets are placed in a sheet feed stage, the sheet feed stage containing the tab sheets is automatically selected in the inter-OHP insertion mode, and in which information of the OHP page number and/or the page title can be recorded on a tab and/or a tab sheet by effectively utilizing the tab sheet.

(Third Embodiment)

The above first embodiment is intended to provide the arrangement that, when tab sheets are placed in a sheet feed stage, the sheet feed stage containing the tab sheets is automatically selected in the inter-OHP insertion mode. The arrangement may be modified to make it possible to set which one of an ordinary sheet and a tab sheet is automatically supplied, when an inserted sheet is supplied in the inter-OHP insertion mode. An embodiment having such a modified arrangement will be described below.

An image forming apparatus of this third embodiment is assumed to have the same control system as that in the first embodiment. When an inter-OHP inserted sheet setting key (not shown) in the user mode screen of FIG. 4 is depressed, a subwindow (inserted-sheet type selection screen) for setting the type of inserted sheets through on/off setting as to whether tab sheets are automatically selected as the inserted sheets is displayed as shown in FIG. 21.

Figure 21:
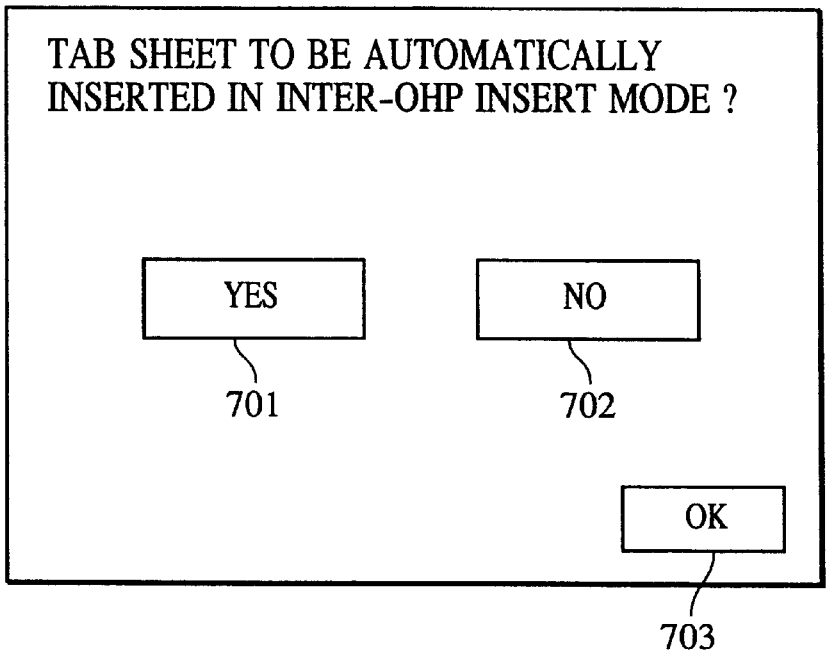
FIG. 21 is a representation showing one example of a subwindow (inserted-sheet type selection screen) for setting the type of inserted sheets through on/off setting as to whether tab sheets are automatically selected as the inserted sheets.

FIG. 21 is a representation showing one example of a subwindow (inserted-sheet type selection screen) for setting the type of inserted sheets through on/off setting as to whether tab sheets are automatically selected as the inserted sheets. The subwindow is displayed on the LCD 304 shown in FIG. 3 upon depression of the inter-OHP inserted sheet setting key (not shown) in the user mode screen of FIG. 4.

Referring to FIG. 21, numeral 701 denotes a "yes" button. By selecting the "yes" button 701 and then depressing an OK key 703, tab sheets are set as the type of inserted sheets. Then, if the tab sheet feed stage having the same size as OHP sheets, on which images are to be copied, is set in the inter-OHP insertion mode, the tab sheets are supplied and ejected as the inserted sheets. Numeral 702 denotes a "no" button. By selecting the "no" button 702 and then depressing the OK key 703, ordinary sheets having the same size as OHP sheets, on which images are to be copied, are set as the type of inserted sheets. Then, upon selection of the inter-OHP insertion mode, the ordinary sheets having the same size as the OHP sheets are supplied and ejected as the inserted sheets. Note that the setting data entered on the screens of FIG. 21 is stored in the internal RAM (not shown) of the main unit controller 100 shown in FIG. 1.

The operation of the image forming apparatus according to the third embodiment of the present invention will be described below with reference to a flowchart shown in FIG. 22.

Figure 22:
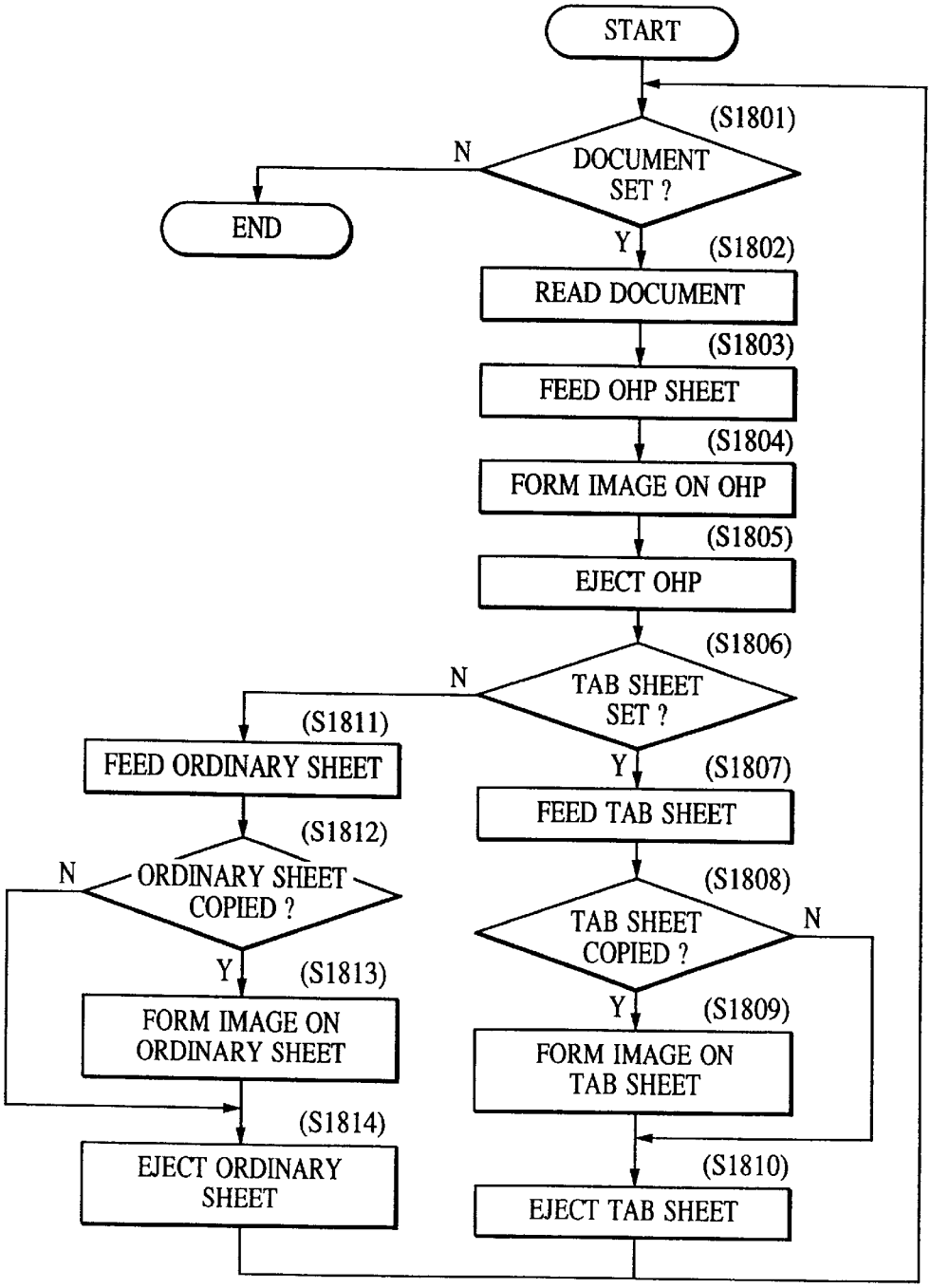
FIG. 22 is a flowchart showing one example of a third control processing procedure in the image forming apparatus of the present invention.

FIG. 22 is a flowchart showing one example of a third control processing procedure in the image forming apparatus of the present invention. This procedure represents the processing executed upon the copy start key 302 being depressed after the inter-OHP insertion mode is selected on the application mode screen of FIG. 10. The flowchart of FIG. 22 is executed by the CPU (not shown), which is incorporated in the main unit controller 100 shown in FIG. 1, in accordance with a program stored in the ROM (not shown) or another storage medium. S1801 to S1814 represent successive steps. It is here assumed that an input from the copy start key 302 is accepted only when there is an ordinary sheet or a tab sheet having the same size as an OHP sheet, and the number of output copy is one.

First, whether a document to be read still remains is determined by a sensor (not shown) associated with the document reader 118 shown in FIG. 1 or the ADF 280 shown in FIG. 2 (S1801). If one or more documents still remain, image data of one document is read (S1802), and an OHP sheet is supplied from the multi-manual feed tray 254 (S1803). An image is formed on the supplied OHP sheet based on the read image data of the document (S1804), and the OHP sheet having the image formed thereon is ejected (S1805).

Next, the CPU determines whether tab sheets are automatically supplied as inserted sheets set on the user mode screen of FIG. 4 (S1806). If the setting to supply tab sheets automatically is determined in step S1806, the tab sheet is supplied from the selected tab sheet feed stage (S1807). The CPU then determines whether "copy" is selected on the screen, shown in FIG. 15, for setting whether to copy an image on an inserted sheet or not (S1808). If "copy" is selected, an image is formed on the tab sheet based on the read image data of the document (S1809), and the tab sheet having the image formed thereon is ejected (S1810). If "copy" is not selected in step S1808, the tab sheet is ejected without forming an image on it (S1810).

On the other hand, if the setting to supply tab sheets automatically is determined in step S1806, an ordinary sheet having the same size as the OHP sheet is supplied (S1811). Then, the CPU determines whether "copy" is selected on the screen, shown in FIG. 15, for setting whether to copy an image on an inserted sheet or not (S1812). If "copy" is selected, an image is formed on the supplied ordinary sheet based on the read image data of the document (S1813), and the ordinary sheet having the image formed thereon is ejected (S1814). If "copy" is not selected in step S1812, the ordinary sheet is ejected without forming an image on it (S1814).

After ejection of the inserted sheet in step S1810 or S1814, the CPU returns to step S1801 and repeats the processing of steps S1801 to S1814 until there is no longer a document to be read in step S1801 (i.e., until all documents images are completely read). The processing is ended upon detection of no more documents to be read.

This embodiment has been described in connection with the arrangement that, which one of tab sheets and ordinary sheets having the same size as OHP sheets is selected as the type of inserted sheets, is set by making the ON/OFF setting to select tab sheets as inserted sheets automatically on the inserted-sheet type selection screen of FIG. 21. However, the arrangement may be modified so as to directly set the type of inserted sheets to any of tab sheets, ordinary sheets having the same size as OHP sheets, color sheets, ordinary sheets having A4 and B5 sizes, etc.

More specifically, in initial setting, the CPU first prompts users to designate the sheet type (media type) for each of the sheet feed stages, and acquires media type information for each of the sheet feed stages beforehand by displaying an operating screen. Then, the media type information is stored as sheet-feed-stage management information in an internal memory of the image forming apparatus in the form of a table, for example, along with sheet size information and sheet presence/absence information obtained from a sheet size sensor and a sheet presence/absence sensor which are provided on each of the sheet feed stages. The media type information, the sheet size information and the sheet presence/absence information are managed separately for each of the sheet feed stages. While the media type information is acquired as information designated by users in the above case, the media type information may be obtained, for example, by providing a sensor capable of detecting the media type in each of the sheet feed stages.

Then, when users depress the start key 305 on the operation panel after the above-described initial setting, the application mode setting screen of FIG. 10 is displayed on the LCD 304. Subsequently, when the inter-OHP insertion mode is selected upon the button 350 being depressed by the users on the screen of FIG. 10, an inserted-sheet material setting screen 3200, shown in FIG. 23, for setting the type of sheets, which are to be used as inter-OHP inserted sheets in the inter-OHP insertion mode, is displayed on the LCD 304 in addition to the OHP sheet-size selection screen shown in FIG. 14. It is a matter of choice to display first which one of the screen of FIG. 14 and the screen 3200 of FIG. 23. The screen 3200 also displays information based on the sheet-feed-stage management information described above.

Figure 23:
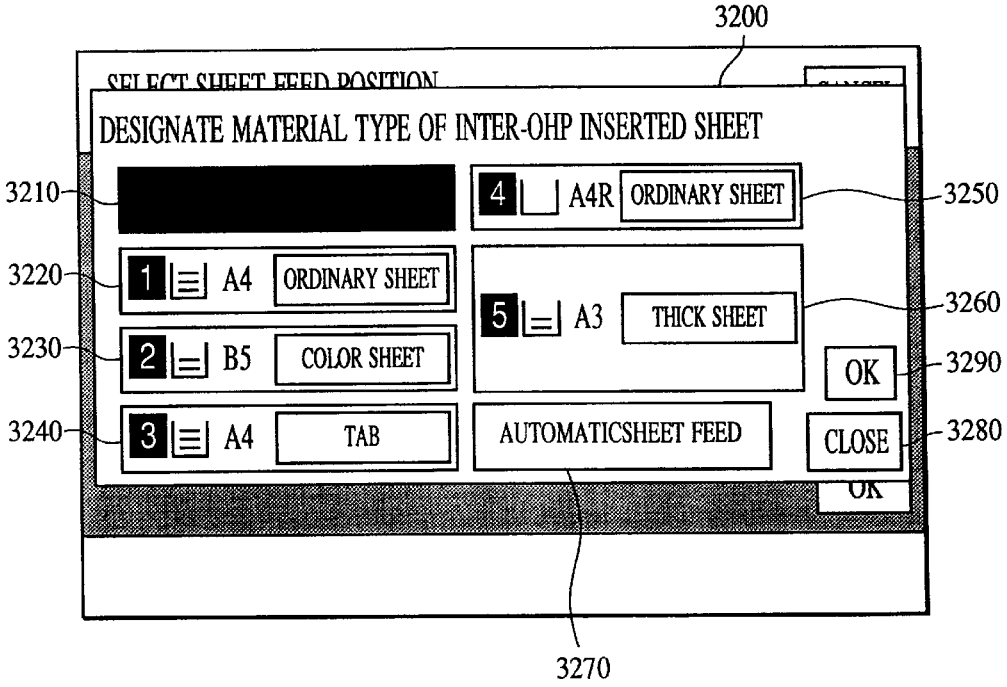
FIG. 23 is a representation showing one example of a media type setting screen on which the media type of inserted sheet is set in the inter-OHP insertion mode.

On the screen 3200 of FIG. 23, the CPU prompts the users to designate, among plural candidates of media types including tab sheets, one that is to be used as the inter-OHP inserted sheets. In the example of FIG. 23, an icon of No. 1 cassette represents that the media type is "ordinary sheet", the sheet size is "A4", and sheets are placed. An icon of No. 2 cassette represents that the media type is "color sheet", the sheet size is "B5", and sheets are placed. An icon of No. 3 cassette represents that the media type is "stab sheet", the sheet size is "A4", and sheets are placed. An icon of No. 4 cassette represents that the media type is "ordinary sheet", the sheet size is "A4R", and sheets are not placed. An icon of No. 5 cassette represents that the media type is "thick sheet", the sheet size is "A3", and sheets are placed.

Then, looking at the displayed information regarding the sheet feed stages, users can select the type of inserted sheets used in the inter-OHP insertion mode. Herein, the copy is started by selecting a button 3240 corresponding to the sheet feed stage in which tab sheets are placed as the inter-OHP inserted sheets, and depressing an OK button 3290 to close the screen 3200 for establishment of the setting. Responsively, the image forming apparatus operates such that the inserted sheets in the inter-OHP insertion mode are supplied from the sheet feed stage corresponding to the No. 3 cassette in which tab sheets are placed, and each time one OHP sheet is output, the tab sheet is supplied from that sheet feed stage for insertion between the OHP sheets.

Additionally, after the type of tab sheets has been selected on the inter-OHP inserted sheet type setting screen 3200 of FIG. 23 displayed in response to selection of the inter-OHP insertion mode, the screens of FIGS. 15 and 18 related to the setting of tab sheets may also be displayed. In such a case, however, when tab sheets are used as the inserted sheets in the inter-OHP insertion mode, the display control is performed not to display the screen, shown in FIG. 13, for designating the tab-sheet inserted positions, as with the above embodiment, so that the tab sheets are each inserted between the OHP sheets (the OHP sheets and the tab sheets are output alternately one by one) without requiring users to make the setting for designating the tab-sheet inserted positions.

As a result, in the case of using tab sheets as the inserted sheets in the inter-OHP insertion mode, users can be free from an extra operating action such as requiring users to make the setting for designating the tab-sheet inserted positions in spite of the tab-sheet inserted positions being already specified. Also, since erroneous operations are avoided from being caused by such an extra setting action, convenience in operability for users can be improved.

In the present invention, this third embodiment may be combined with the above second embodiment. With such a combination, when the inter-OHP insertion mode is selected and sheets to be inserted between the OHP sheets are selected as ones supplied from the tab sheet feed stage, it is possible to select not only whether the page number is printed on a tab of each tab sheet, but also whether a text copied on an OHP sheet is also copied on a tab sheet.

This embodiment is likewise applicable to the case where image data from a host computer is recorded on sheets. More specifically, it is possible to designate the inter-OHP insertion mode and to select the sheet feed stage for inserted sheets as the tab-sheet feed stage from a printer driver in the host computer. In such a case, the printer driver may be arranged to be able to select whether the page number is printed on a tab, and whether the title name of each page of image data is printed on a tab sheet. Then, an image is printed on the tab sheet, as the inserted sheet, in accordance with the page information, the title information, the information regarding whether to print the page number on a tab or not, and the information regarding whether to print the title name or not, which are sent from the host computer.

Through the processing described above, an image forming apparatus can be provided in which when the setting to supply tab sheets automatically in the inter-OHP insertion mode is made beforehand in a step for setting whether tab sheets are automatically supplied as inter-OHP inserted sheets, the sheet feed stage containing the tab sheets can be automatically selected in the inter-OHP insertion mode, and in which information of the OHP page number and/or the page title can be recorded on a tab and/or a tab sheet by effectively utilizing the tab sheet.

In the above embodiments, the printer section (printer engine) has been described as being of the laser beam type. However, the present invention can also be applied to printer engines employing, in addition to the laser beam type, any other printing types such as electrophotographic (e.g., LED)

type, liquid crystal shutter type, ink jet type, thermal transfer type, and sublimation type.

The configuration of data processing programs readable by the image forming apparatus according to the present invention will be described below with reference to a memory map shown in FIG. 24.

FIG. 24 is a representation for explaining a memory map of a storage medium that stores various data processing programs readable by the image forming apparatus according to the present invention.

In some cases, though not specifically shown, information for management of program groups stored in the storage medium, such as version information and creator name, and information depending upon OS, etc. used on the program reading side, such as icons for identifying and indicating programs, are also stored in the storage medium.

Further, data belonging to the various programs are also managed in directories of the memory map. When installed programs and data are compressed, a decompressing program, etc. may be stored in the storage medium.

The functions in the above embodiments, shown in FIGS. 17, 20 and 22, may be executed by the host computer using a program installed externally. Thus, the present invention is applicable to the case where an information group including the programs is supplied to the image forming apparatus from an external storage medium, such as a CD-ROM, flash memory and FD, or via a network.

Moreover, the objects of the present invention can be achieved by supplying, to a system or apparatus, a storage medium that stores program codes of software for realizing the functions of the above-described embodiments, and by causing a computer (CPU and/or MPU) in the system or apparatus to read and execute the program codes stored in the storage medium.

In such a case, the program codes read out of the storage medium serve in themselves to realize the novel functions of the present invention. Hence, the storage medium storing the program codes constitutes the present invention.

Storage mediums for supplying the program codes may be, e.g., floppy disks, hard disks, optical disks, magneto-optical disks, CD-ROMs, CD-Rs, DVD-ROMs, magnetic tapes, nonvolatile memory cards, ROMs, EEPROMs, and silicon disks.

Also, the functions of the above-described embodiments can be realized not only by a computer executing the program codes read out of the storage medium, but also by an OS (Operating System) or the like which is working on the computer and executes a part or the whole of the actual processing in accordance with instructions from the program codes, thereby realizing the functions of the above-described embodiments.

Further, the present invention involves such a case in which the program codes read out of the storage medium are written in a memory provided in a function add-on board mounted in the computer or a function add-on unit connected to the computer, and a CPU or the like incorporated in the function add-on board or unit executes a part or the whole of the actual processing in accordance with instructions from the program codes, thereby realizing the functions of the above-described embodiments.

The present invention is applicable not only to a system constituted by plural pieces of equipment, but also to an apparatus constituted by a single piece of equipment. As a matter of course, the present invention can be applied to the case of supplying programs to a system or apparatus for achieving the objects. In such a case, the system or apparatus can provide the advantages of the present invention by reading and executing the programs in the form of software for achieving the objects from a storage medium, which stores the software.

Additionally, the system or apparatus can also provide the advantages of the present invention by reading and executing the programs in the form of software for achieving the objects, after downloading the software from a database on a network through a communication program.

According to the embodiments, as described above, the following advantages can be provided. When the inter-OHP inserting function is selected by an inter-OHP inserting function selecting unit, tab sheets are automatically supplied for insertion between OHP sheets from the sheet feed stage, which has been set as a tab sheet feed stage. Therefore, the tab sheets can be each automatically inserted between the OHP sheets without requiring users to perform a troublesome separate operation again for additionally setting the sheet feed stage, on which the tab sheets are placed, as the sheet feed stage for inserted sheets.

Also, whether to form an image on a tab sheet, as an inserted sheet, in the inter-OHP insertion mode or not can be set. Then, the image forming apparatus is controlled such that when the setting not to form an image on a tab sheet is selected, no image is formed on the tab sheet, and when the setting to form an image on a tab sheet is selected, the image is formed on the tab sheet including its tab. Therefore, an image can be formed on a tab sheet with a simpler user operation in addition to the above-described advantage.

Further, when the setting to form an image on a tab sheet is selected in the above setting step, the image forming apparatus is controlled such that information associated with the OHP sheet (including the page number information, the title information, and the same document information as that formed on the OHP sheet) is recorded on the tab sheet including its tab. Therefore, the following advantage can be provided in addition to the above-described advantages. The information associated with the OHP sheet, such as the OHP page number information, the page title information and the document image information, can be recorded on the tab sheet and/or its tab by effectively utilizing the tab sheet.

Since the setting not to form an image on a tab sheet, which is supplied as an inserted sheet in the inter-OHP insertion mode, is made as initial setting, it is possible to prevent an image from being formed on a tab sheet by a mistake.

Moreover, in response to selection of the inter-OHP insertion mode, the screen for prompting users to select the sheet type to be used as inserted sheets and for enabling tab sheets to be designated as the inserted sheets is displayed so that the users can select the tab sheets as the inserted sheets which are to be inserted between OHP sheets. Therefore, the following advantages can be provided in addition to the above-described advantages. Images can be formed on one type of sheets, such as OHP sheets, while another type of sheets, such as tab sheets, can be output and inserted between the former type sheets. It is hence possible to avoid the user operation from becoming complicated and to keep users from suffering an increased burden.

Still further, the display control is performed such that the user setting made in the tab sheet output mode to designate the positions, at which tab sheets are to be inserted, is prohibited when the inter-OHP insertion mode is selected and the tab sheets are used. Therefore, the following advantages can be provided in addition to the above-described advantages. In the case of using tab sheets as inserted sheets in the inter-OHP insertion mode, it is possible to eliminate an extra setting action imposed on users, to avoid erroneous operations from being caused by such an extra setting action, and to further improve the operability.

When the inter-OHP inserting function is selected by the inter-OHP inserting function selecting unit, users are prompted to set whether sheets to be each inserted between OHP sheets are supplied from the sheet feed stage, which has been set as a tab sheet feed stage, and another sheet feed stage. Therefore, when the setting to supply tab sheets automatically in the inter-OHP insertion mode is made beforehand in a step for setting whether tab sheets are automatically supplied as inter-OHP inserted sheets, the sheet feed stage containing the tab sheets can be automatically selected in the inter-OHP insertion mode.

Accordingly, when tab sheets are placed in the sheet feed stage, the tab sheets can be automatically supplied and inserted between OHP sheets without requiring users to perform a troublesome separate operation again for additionally setting the sheet feed stage, on which the tab sheets are placed, as the sheet feed stage for inserted sheets. Further, information of the OHP page number and/or the page title can be recorded on a tab and/or a tab sheet by effectively utilizing the tab sheet.

Thus, according to the embodiments, when providing an image forming apparatus which can form images on one type of sheets, such as OHP sheets, and at the same time can output another type of sheets, such as tab sheets, to be inserted between the former type sheets, it is possible to avoid the user operation from becoming complicated and to keep users from suffering an increased burden. In addition, a desired output result easily handled by the users can be provided.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus capable of selectively executing various operating modes including an inter-OHP insertion mode in which images are formed on OHP sheets and another type of sheet different from the OHP sheet is inserted between the OHP sheets having the images formed thereon, and a tab sheet output mode in which an image can be formed on a tab sheet, said image forming apparatus comprising:

tab-sheet storage unit designating means for designating a storage unit from among a plurality of storage units each containing different type sheets; and inter-OHP tab sheet inserting means for, when the inter-OHP insertion mode is selected, automatically feeding the sheet to be inserted between the OHP sheets from the storage unit designated by said tab-sheet storage unit designating means.

2. An image forming apparatus according to claim 1, further comprising:

tab-sheet image formation setting means for setting whether an image is formed on a tab sheet fed by said inter-OHP tab sheet inserting means; and control means for controlling the apparatus not to form an image on the tab sheet when setting not to form an image is made by said tab-sheet image formation setting means, and for controlling the apparatus to form an image on a recording medium including a tab of the tab sheet when setting to form an image is made by said tab-sheet image formation setting means.

3. An image forming apparatus according to claim 2, wherein said control means controls the apparatus to record information associated with the OHP sheet on a recording medium including a tab of the tab sheet when setting to form an image is made by said tab-sheet image formation setting means.

4. An image forming apparatus according to claim 3, wherein the information associated with the OHP sheet includes the page number of the OHP sheet.

5. An image forming apparatus according to claim 3, wherein the information associated with the OHP sheet includes title information for the OHP sheet.

6. An image forming apparatus according to claim 3, wherein the information associated with the OHP sheet includes image information to be formed on the OHP sheet.

7. An image forming apparatus according to claim 2, wherein said tab-sheet image formation setting means makes, an initial setting, the setting not to form an image on a tab sheet fed by said inter-OHP tab sheet inserting means.

8. An image forming apparatus having an inter-OHP insertion mode in which images are formed on OHP sheets and another type of sheet different from the OHP sheet is inserted between the OHP sheets having the images formed thereon, and being able to form an image on a tab sheet, said image forming apparatus comprising:

inter-OHP inserted sheet selecting means for selecting the type of the sheet to be inserted between the OHP sheets from among tab sheets and another type sheet; and control means for controlling the apparatus to record information associated with the OHP sheet on a recording medium including a tab of a tab sheet when a tab sheet is selected by said inter-OHP inserted sheet selecting means.

9. An image forming apparatus according to claim 8, wherein the information associated with the OHP sheet includes the page number of the OHP sheet.

10. An image forming apparatus according to claim 8, wherein the information associated with the OHP sheet includes title information of the OHP sheet.

11. An image forming apparatus according to claim 8, wherein the information associated with the OHP sheet includes image information to be formed on the OHP sheet.

12. An image forming apparatus including inter-OHP inserting function selecting means for selecting an inter-OHP insertion mode in which images are formed on OHP sheets and another type of sheet different from the OHP sheet is inserted between the OHP sheets having the images formed thereon, and being able to form an image on a tab sheet, said image forming apparatus comprising:

tab-sheet feed stage designating means for designating one of a plurality of storage units storing sheets, which stores tab sheets; and inserted sheet setting means for, when the inter-OHP insertion mode is selected by said inter-OHP inserting function selecting means, setting whether the sheet to be inserted between the OHP sheets is a tab sheet fed from the storage unit designated by said tab-sheet feed stage designating means or another type of sheet from a different one of the plurality of storage units.

13. A control method for an image forming apparatus including inter-OHP inserting function selecting means for selecting an inter-OHP insertion mode in which images are formed on OHP sheets and another type of sheet different from the OHP sheet is inserted between the OHP sheets having the images formed thereon, the apparatus being able to form an image on a tab sheet, said control method comprising the steps of:

a tab-sheet feed stage designating step of designating a storage unit from among a plurality of storage units each containing different type sheets; and an inter-OHP tab sheet inserting step of, when the inter-OHP insertion mode is selected by said inter-OHP inserting function selecting means, automatically feeding the sheet to be inserted between the OHP sheets from the storage unit designated in said tab-sheet feed stage designating step.

14. A control method for an image forming apparatus including inter-OHP inserting function selecting means for selecting an inter-OHP insertion mode in which images are formed on OHP sheets and another type of sheet different from the OHP sheet is inserted between the OHP sheets having the images formed thereon, the apparatus being able to form an image on a tab sheet, said control method comprising the steps of:

an inter-OHP inserted sheet selecting step of selecting the type of the sheet to be inserted between the OHP sheets from among tab sheets and another type sheet; and a recording step of recording information associated with the OHP sheet on a recording medium including a tab of a tab sheet when a tab sheet is selected in said inter-OHP inserted sheet selecting step.

15. A control method for an image forming apparatus including inter-OHP inserting function selecting means for selecting an inter-OHP insertion mode in which images are formed on OHP sheets and another type of sheet different from the OHP sheet is inserted between the OHP sheets having the images formed thereon, the apparatus being able to form an image on a tab sheet, said control method comprising the steps of:

a tab-sheet feed stage designating step of designating a storage unit storing tab sheets; and an inserted tab sheet setting step of, when the inter-OHP insertion mode is selected by said inter-OHP inserting function selecting means, setting whether the sheet to be inserted between the OHP sheets is a tab sheet fed from the storage unit designated in said tab-sheet feed stage designating step or another type of sheet from a different one of the plurality of storage units.

16. A storage medium product storing a program readable by a computer, said program executing a control process for an image forming apparatus including inter-OHP inserting function selecting means for selecting an inter-OHP insertion mode in which images are formed on OHP sheets and another type of sheet different from the OHP sheet is inserted between the OHP sheets having the images formed thereon, the apparatus being able to form an image on a tab sheet, said control process comprising the steps of:

a tab-sheet feed stage designating step of designating a storage unit from among a plurality of storage units each containing different type sheets; and an inter-OHP tab sheet inserting step of, when the inter-OHP insertion mode is selected by said inter-OHP inserting function selecting means, automatically feeding the sheet to be inserted between the OHP sheets from the storage unit designated in said tab-sheet feed stage designating step.

17. A storage medium product storing a program readable by a computer, said program executing a control process for an image forming apparatus comprising first image forming means for forming an image on an OHP sheet, inter-OHP inserting function selecting means for selecting an inter-OHP inserting function in which another type of sheet different from the OHP sheet is inserted between the OHP sheets having the images formed thereon, and second image forming means for forming an image on a tab sheet, said control process comprising the steps of:

an inter-OHP inserted sheet selecting step of selecting the type of the sheet to be inserted between the OHP sheets from among tab sheets and another type sheet; and a recording step of recording information associated with the OHP sheet on a recording medium including a tab of a tab sheet when a tab sheet is selected in said inter-OHP inserted sheet selecting step.

18. A storage medium product storing a program readable by a computer, said program executing a control process for an image forming apparatus comprising first image forming means for forming an image on an OHP sheet, inter-OHP inserting function selecting means for selecting an inter-OHP inserting function in which another type of sheet different from the OHP sheet is inserted between the OHP sheets having the images formed thereon, and second image forming means for forming an image on a tab sheet, said control process comprising the steps of:

a tab-sheet feed stage designating step of designating a feed stage storing tab sheets; and an inserted sheet setting step of, when the inter-OHP inserting function is selected by said inter-OHP inserting function selecting means, setting whether the sheet to be inserted between the OHP sheets is a tab sheet fed from the feed stage designated in said tab-sheet feed stage designating step or another type of sheet from a different one of the feed stages.

19. A control apparatus for controlling an image forming apparatus having a first mode for inserting, between first type sheets, one of plural types of sheets including a second type sheet having sheet type different from the first type sheet, and a second mode different from the first mode, said control apparatus comprising:

mode selecting means for selecting the first mode;

display control means for, when the first mode is selected by said mode selecting means, providing a display enabling users to select the second type sheet from among the plural types of sheets as the sheet type which is to be inserted between the first type sheets; and control means for controlling said image forming apparatus, in response to selection of the second type sheet through the display provided by said display control means, such that the second type sheet of the plural types of sheets is inserted between the first type sheets.

20. A control apparatus according to claim 19, wherein the first type sheet includes an OHP sheet and the second type sheet includes a tab sheet having a tab.

21. A control apparatus according to claim 19, wherein in the first mode, the first type sheet and a sheet having sheet type different from the first type sheet are ejected alternately one by one.

22. A control apparatus according to claim 21, wherein the second mode is for inserting a plurality of second type sheets in a series of sheet bundles made up of plural pages;

said image forming apparatus further comprises setting means for prompting users to set pages at which the second type sheets are to be inserted, when the second type sheets are used in the second mode;

said control means controls said image forming apparatus to execute a process of inserting the second type sheets in accordance with settings made by the users through said setting means, when the second type sheets are used in the second mode; and said control means controls said image forming apparatus to execute a process of inserting the second type sheet between the first type sheets without prompting the users to make settings through said setting means, when the second type sheets are used in the first mode.

23. A control apparatus according to claim 22, wherein said control means controls said image forming apparatus to insert the second type sheets at pages set by the users through said setting means, when the second type sheets are used in the second mode, and to eject one second type sheet each time one first type sheet is output, when the second type sheets are used in the first mode.

24. A control apparatus according to claim 19, wherein said display control means provides a display enabling users to select one of plural candidates of types, including the second type, as the sheet type to be inserted in the first type sheets.

25. A control apparatus according to claim 24, wherein the plural candidates of types include an ordinary sheet and a tab sheet having a tab.

26. A control apparatus according to claim 24, wherein said image forming apparatus has a plurality of containers for containing sheets; and said display control means provides a display enabling sheets types to be identified for each of the plurality of containers.

27. A control apparatus according to claim 26, wherein said display control means provides a display indicating the sheet types, and a display enabling a sheet size and sheet presence to be identified for each of the plurality of containers.

28. A control apparatus according to claim 19, wherein the plural types of sheets include an ordinary sheet, an OHP sheet, a color sheet, and a tab sheet having a tab.

29. A control apparatus for controlling an image forming apparatus having a first mode for inserting, between first type sheets, one of plural types of sheets including a second type sheet having sheet type different from the first type sheet, and a second mode for inserting one or more second type sheets in a series of sheet bundle made up of plural pages, said image forming apparatus comprising:

setting means for prompting users to set pages at which the second type sheets are inserted, when the second type sheets are selected from among the plural types of sheets for use in the second mode; and control means for controlling said image forming apparatus to insert the second type sheets at pages, which are set by the users through said setting means, when the second type sheets are used in the second mode, and to eject the first type sheet and the second type sheet alternately one by one without prompting the users to make page setting of the second type sheets through said setting means, when the second type sheets are used in the first mode.

30. A control method for controlling an image forming apparatus having a first mode for inserting, between first type sheets, one of plural types of sheets including a second type sheet having sheet type different from the first type sheet, and a second mode different from the first mode, said control method comprising the steps of:

a mode selecting step of selecting the first mode;

a display control step of, when the first mode is selected in said mode selecting step, providing a display enabling users to select the second type sheet from among the plural types of sheets as the sheet type which is to be inserted between the first type sheets; and a control step for controlling said image forming apparatus, in response to selection of the second type sheet through the display provided in said display control step, such that the second type sheet of the plural types of sheets is inserted between the first type sheets.

31. A storage medium product storing a program readable by a computer, said program executing a control process for controlling an image forming apparatus having a first mode for inserting, between first type sheets, one of plural types of sheets including a second type sheet having sheet type different from the first type sheet, and a second mode different from the first mode, said control process comprising the steps of:

a mode selecting step of selecting the first mode;

a display control step of, when the first mode is selected in said mode selecting step, providing a display enabling users to select the second type sheet from among the plural types of sheets as the sheet type which is to be inserted between the first type sheets; and a control step for controlling said image forming apparatus, in response to selection of the second type sheet through the display provided in said display control step, such that the second type sheet of the plural types of sheets is inserted between the first type sheets.

32. A control method for controlling an image forming apparatus having a first mode for inserting, between first type sheets, one of plural types of sheets including a second type sheet having sheet type different from the first type sheet, and a second mode for inserting one or more second type sheets in a series of sheet bundle made up of plural pages, said control method comprising the steps of:

a setting step of prompting users to set pages at which the second type sheets are inserted, when the second type sheets are used in the second mode; and a control step of controlling said image forming apparatus to insert the second type sheets at pages, which are set by the users in said setting step, when the second type sheets are used in the second mode, and to eject the first type sheet and the second type sheet alternately one by one without prompting the users to make page setting of the second type sheets in said setting step, when the second type sheets are selected from among the plural types of sheets for use in the first mode.

33. A storage medium product storing a program readable by a computer, said program executing a control process for controlling an image forming apparatus having a first mode for inserting, between first type sheets, one of plural types of sheets including a second type sheet having sheet type different from the first type sheet, and a second mode for inserting one or more second type sheets in a series of sheet bundle made up of plural pages, said control process comprising the steps of:

a setting step of prompting users to set pages at which the second type sheets are inserted, when the second type sheets are used in the second mode; and a control step of controlling said image forming apparatus to insert the second type sheets at pages, which are set by the users in said setting step, when the second type sheets are used in the second mode, and to eject the first type sheet and the second type sheet alternately one by one without prompting the users t make page setting of the second type sheets in said setting step, when the second type sheets are selected from among the plural types of sheets for use in the first mode.

34. An operating method in a system which includes an image forming apparatus having a first mode for inserting, between first type sheets, one of plural types of sheets including a second type sheet having sheet type different from the first type sheet, and a second mode different from the first mode, said method comprising the steps of:

a mode selecting step of selecting the first mode;

a display control step of, when the first mode is selected in said mode selecting step, causing a display unit to perform a display enabling users to select the second type sheet from among the plural types of sheets as the sheet type which is to be inserted between the first type sheets; and a control step of causing said image forming apparatus to select the second type sheet, such that the second type sheet of the plural types of sheets is inserted between the first type sheets, in response to selection of the second type sheet through the display provided in said display control step.

35. A method according to claim 34, wherein the first type sheet includes an OHP sheet and the second type sheet includes a tab sheet having a tab.

36. A method according to claim 34, wherein in the first mode, the first type sheet and a sheet having sheet type different from the first type sheet are ejected alternately one by one.

37. A method according to claim 34, wherein the second mode is for inserting a plurality of second type sheets in a series of sheet bundle made up of plural pages;

the display control step causes the display unit to perform a display enabling users to set pages at which the second type sheets are to be inserted, when the second type sheets are used in the second mode;

the control step controls the image forming apparatus to execute a process of inserting the second type sheets in accordance with page setting of the second type sheets by the users when the second type sheets are used in the second mode; and the control step controls the image forming apparatus to execute a process of inserting the second type sheet between the first type sheets without the page setting of the second type sheets by the users when the second type sheets are used in the first mode.

38. A method according to claim 37, wherein the control step controls the image forming apparatus to insert the second type sheets at pages set by the users when the second type sheets are used in the second mode, and to eject one second type sheet each time one first type sheet is output, when the second type sheets are used in the first mode.

39. A method according to claim 34, wherein the display control provides a display enabling users to select one of plural candidates of types, including the second type, as the sheet type to be inserted in the first type sheets.

40. A method according to claim 39, wherein the plural candidates of types include an ordinary sheet and a tab sheet having a tab.

41. A method according to claim 39, wherein the image forming apparatus has a plurality of containers for containing sheets; and the display control provides a display enabling sheet types to be identified for each of the plurality of containers.

42. A method according to claim 41, wherein the display control provides a display indicating the sheet types, and a display enabling a sheet size and sheet presence to be identified for each of the plurality of containers.

43. A method according to claim 34, wherein the plural types of sheets include an ordinary sheet, an OHP sheet, a color sheet, and a tab sheet having a tab.

44. A method according to claim 34, wherein the selection process in said selecting step and the display process in said display control step are performed through an operation unit provided to said image forming apparatus.

45. A method according to claim 34, wherein the selection process in said selecting step and the display process in said display control step are performed through a printer driver of a computer which is able to communicate with said image forming apparatus.

46. A method according to claim 34, wherein said image forming apparatus has a plurality of functions including a copying function and a printing function for printing data from an external apparatus.

47. An operating method in a system which includes an image forming apparatus having a first mode for inserting, between first type sheets, one of plural types of sheets including a second type sheet having sheet type different from the first type sheet, and a second mode for inserting one or more second type sheets in a series of sheet bundle made up of plural pages, said method comprising the steps of:

a setting step of prompting users to set pages at which the second type sheets are inserted, when the second type sheets are used in the second mode; and a control step of controlling said image forming apparatus to insert the second type sheets at pages, which are set by the users in said setting step, when the second type sheets are used in the second mode, and to eject the first type sheet and the second type sheet alternately one by one without prompting the users to make page setting of the second type sheets in said setting step, when the second type sheets are selected from among the plural types of sheets for use in the first mode.

48. A method according to claim 47, wherein the first type sheet includes an OHP sheet and the second type sheet includes a tab sheet having a tab.

49. A method according to claim 48, wherein the plural candidates of types include an ordinary sheet and a tab sheet having a tab.

50. A method according to claim 47, wherein the plural types of sheets include an ordinary sheet, an OHP sheet, a color sheet, and a tab sheet having a tab.

51. A method according to claim 47, wherein the setting process in said setting step and the control in said control step are performed through an operation unit provided to said image forming apparatus.

52. A method according to claim 47, wherein the setting process in said setting step and the control in said control step are performed through a printer driver of a computer which is able to communicate with said image forming apparatus.

53. A method according to claim 47, wherein said image forming apparatus has a plurality of functions including a copying function and a printing function for printing data from an external apparatus.

* * * * *

UNITED STATES PATENT AND TRADEMARK OFFICE

CERTIFICATE OF CORRECTION

PATENT NO. : 6,751,426 B2
DATED : June 15, 2004
INVENTOR(S) : Rieko Akiba et al

It is certified that error appears in the above-identified patent and that said Letters Patent is hereby corrected as shown below:

Column 4,
Line 42, “in” should be deleted.

Column 7,
Line 38, “is” should read -- are --.

Column 10,
Line 56, “shown” should read -- shown in --.

Column 15,
Line 36, “display” should read -- displays --.

Column 16,
Line 26, “(e.g., a” should read -- (e.g., an --.

Column 20,
Line 67, “to.” should be deleted.

Column 29,
Line 27, “avoid” should read -- prevent --.

Column 30,
Line 20, “makes,” should read -- makes --.

Column 33,
Line 28, “sheets” should read -- sheet --.
Line 43, “bundle” should read -- bundles --.

UNITED STATES PATENT AND TRADEMARK OFFICE

CERTIFICATE OF CORRECTION

PATENT NO. : 6,751,426 B2
DATED : June 15, 2004
INVENTOR(S) : Rieko Akiba et al

It is certified that error appears in the above-identified patent and that said Letters Patent is hereby corrected as shown below:

Column 34,
Lines 35 and 56, “bundle” should read -- bundles --.
Line 67, “t” should read -- to --.

Column 35,
Line 32, “bundle” should read -- bundles --.

Column 36,
Line 28, “bundle” should read -- bundles --.

Signed and Sealed this

Fourteenth Day of September, 2004

JON W. DUDAS
*Director of the United States Patent and Trademark Office*